US009408477B1

(12) United States Patent
Robinson et al.

(10) Patent No.: US 9,408,477 B1
(45) Date of Patent: Aug. 9, 2016

(54) PORTABLE PNEUMATIC SEATING DEVICE

(71) Applicants: William A. Robinson, Point Pleasant, NJ (US); James P. Marlys, Wall, NJ (US)

(72) Inventors: William A. Robinson, Point Pleasant, NJ (US); James P. Marlys, Wall, NJ (US)

( * ) Notice: Subject to any disclaimer, the term of this patent is extended or adjusted under 35 U.S.C. 154(b) by 0 days.

(21) Appl. No.: 14/739,948

(22) Filed: Jun. 15, 2015

Related U.S. Application Data

(60) Provisional application No. 62/012,508, filed on Jun. 16, 2014.

(51) Int. Cl.
*A47C 27/08* (2006.01)
*A47C 7/02* (2006.01)
*A61G 5/10* (2006.01)

(52) U.S. Cl.
CPC ..... *A47C 27/082* (2013.01); *A47C 7/021* (2013.01); *A61G 5/1043* (2013.01); *A61G 5/1056* (2013.01); *A61G 2005/1091* (2013.01)

(58) Field of Classification Search
CPC ..... A47C 27/08
USPC ..... 5/653–654, 710, 713
See application file for complete search history.

(56) References Cited

U.S. PATENT DOCUMENTS 5,848,450 A * 12/1998 Oexman ..... A47C 27/082 5/706
2012/0124744 A1* 5/2012 Hornbach ..... A61G 7/012 5/611
2012/0144588 A1* 6/2012 Heimbrock ..... A61G 5/14 5/624

* cited by examiner

*Primary Examiner* — Fredrick Conley
(74) *Attorney, Agent, or Firm* — Steven M. Hoffberg, Esq.; Ostrolenk Faber LLP

(57) ABSTRACT

A seating device has a portable pneumatic seating platform and at least one pneumatic pad module supporting the ability to pressurize and depressurize at least one pneumatic pad module with the ability to be operated by electrical power.

20 Claims, 24 Drawing Sheets

PORTABLE PNEUMATIC SEATING DEVICE

CROSS REFERENCE TO RELATED APPLICATION

The present application is a non-provisional of U.S. Provisional Patent Application No. 62/012,508, filed Jun. 16, 2014, the entirety of which is expressly incorporated herein by reference in its entirety.

BACKGROUND OF THE INVENTION

The present invention relates to the field of ergonomic surfaces, and more particularly, to variably inflatable cushions for seating surfaces. More particularly, the present invention is in the technical field of pneumatic seating devices. More particularly, the present invention is in the technical field of portable pneumatic seating devices.

Known alternating pressure seat cushions include products from Talley Group www.talleygroup.com/products/cushions/category/alternating; Aquila Corp. www.aquilacorp.com/; Dynamic Air (SLK GmbH) pdf.medicalexpo.com/pdf/slk/alternating-pressure-systems/90741-110749.html#open; Eagle Advanced System easecushion.com/; Ergo Air www.permobilus.com/ergoair.php; Huntleigh Technology Airtech www.arjohuntleigh-medical-directory.co.uk/Product/LoadUniqueProduct/4475#/Product/GetImage/12214?size=Large&uniqueProduct=True; Huntleigh Technology Aura www.arjohuntleigh-medical-directory.co.uk/Product/LoadUniqueProduct/4483#/Product/GetImage/12212?size=Large&uniqueProduct=True; Karomed Transair www.karomed.com/cushions-and-sundries/karomed-transair-alternating-cushion; Pagasus Airwave Altern8 bexar.tx.networkofcare.org/veterans/assistive/product_detail.aspx?id=13013&pid=77984&term=Alternating%20Air%20Pressure%20Flotation%20Seat%20Cushion&c=Seating; Sand Therapeutic, Inc. PASC Cushion www.usatechguide.org/itemreview.php?itemid=123; www.medicalexpo.com/medical-manufacturer/dynamic-air-cushion-15620.html.

See, U.S. Pat. Nos. 4,524,762; 4,796,948; 4,852,195; 5,083,551; 5,269,030; 5,388,292; 5,438,721; 5,444,881; 5,487,197; 5,588,167; 5,592,706; 5,617,595; 5,687,438; 5,701,621; 5,815,864; 5,829,081; 5,836,654; 5,857,749; 5,963,997; 6,014,784; 6,085,372; 6,135,116; 6,216,299; 6,371,976; 6,560,803; 6,668,405; 6,671,911; 6,782,574; 6,823,549; 6,895,988; 6,910,236; 7,007,330; 7,174,589; 7,191,482; 7,214,202; 7,225,486; 7,296,315; 7,387,975; 7,409,735; 7,444,698; 7,480,953; 7,559,400; 7,583,199; 7,617,555; 7,618,382; 7,698,765; 7,774,881; 7,823,219; 7,966,680; 7,996,940; 8,052,630; 8,215,311; 8,306,666; 8,317,776; 8,393,026; 8,555,441; 8,601,620; 8,726,908; 8,757,165; 8,799,011; 8,870,813; 8,935,820; 8,966,997; 8,997,588; 20020027384; 20020073489; 20020105170; 20020133877; 20040045601; 20040083550; 20040222611; 20040226102; 20040237203; 20040250349; 20050022308; 20050097674; 20050154336; 20050263987; 20060064800; 20060149171; 20060150338; 20070056112; 20070157391; 20070163052; 20070234481; 20080028532; 20090000037; 20090133194; 20090250895; 20100042026; 20100095461; 20100121230; 20100198122; 20100218315; 20100268121; 20110094040; 20110125330; 20110144455; 20110252570; 20110289685; 20120078144; 20120116251; 20120259245; 20120259248; 20130019408; 20130081208; 20130091961; 20130092175; 20130139321; 20130146216; 20130180530; 20130180531; 20130205505; 20130255699; 20130298918; 20140048081; 20140048082; 20140059780; 20140090489; 20140110978; 20140115790; 20140208520; 20140290670; 20150014558; 20150045630; 20150059100; 20150128341; 20150128354, each of which is expressly incorporated herein by reference in its entirety.

SUMMARY OF THE INVENTION

The present technology provides a portable pneumatic seating device, having a plurality of inflatable chambers, which are independently controlled for inflation and deflation. The chambers are configured to support, for example, the buttocks, thighs, and lower legs of a person. The system may also be implemented in the form of a mattress, seat or lounge, wheelchair, or the like.

The system provides, for example, a multi-chamber pneumatic cushion system, an electronic control unit, an electrically controllable valve module, a power supply, e.g., rechargeable battery, pneumatic compressor.

The multi-chamber pneumatic cushion system typically has a solid support surface, though other types of supports may be provided. The electronic control module has a user interface which may be provided through a wired or wireless interface. Advantageously, the electronic control module communicates using an industry standard communication protocol. Such as WiFi, Bluetooth, Zigbee or the like. The electronic control may provide an embedded web server to generate a virtual user interface through a browser, or support communications through a native interface, i.e., iOS or Android. Alternately to a web/HTML interface, the smartphone may communicate with the control system using other Internet or cellular telephony protocols, such as SNMP, SMS, MMS, FTP, Telnet, etc.

The power supply is preferably a rechargeable battery, with sufficient power to operate the system in a normal usage pattern for 24-72 hours. When used on a motorized wheelchair, the system may receive its power from the wheelchair power supply.

The compressor, for example, a 12 VDC electric motor operated positive displacement pump. The motor may be a brush or brushless design. An alternate design employs a solenoid pump. The operating pressure is, for example, below 3 psi. The system preferably provides a reciprocating pressure, which increases and decreases to avoid pressure sores. In addition, the pressure changes in the pneumatic devices can operate as actuators to provide gross movement, for example to provide exercise for the extremities of the person supported by the cushion.

The compressor may be controlled to supply air when needed, or to maintain a back-pressure in an accumulation region. A pressure sensor may be provided to sense the pressure in the accumulation region, valve manifold, lines leading to the pneumatic cushions, or the cushions themselves. Pressure relief valves may be provided at set pressures to establish a maximum (desired) pressure, and therefore alleviating a need to finely control the pressure supply.

One aspect of the disclosure is a wireless device which provides a human user interface and which provides control for and feedback from a control device for a dynamically controlled surface. The wireless device may be, for example, a smartphone, executing a native "app" (i.e., code which is downloaded into persistently stored memory, installed, and executable under the smartphone operating system), or a web page which executes and provides functionality through a browser on the smartphone. In either case, the smartphone may provide full control over the control device, or in turn communicate with a remote server through the Internet or cellular telephone network. The smartphone and control device advantageously communicate through Bluetooth or Wifi, though other communication technologies may be employed, such as NFC or any other communication modality available on or through the smartphone.

The control device typically controls one or more compressors/pumps, valves and actuators, and may receive feedback from various sensors. In this mode of operation, the control device of the cushion may relegate complete control to the smartphone, with for example only setting limits on maximum pressure, overuse of battery, misuse of motors, solenoids, valves, actuators, etc., and the like. Preferably, the control device has a local intelligence mode of operation as well, which provides complete internal control of all functions without need for any smartphone, remote server, or other device.

The system has two complementary functions: relief of pressure on the buttocks of the seat occupant, and exercise of the lower extremities. Note that the exercise functionality is optional, and the modular connectors permit other types of devices to be connected to the pneumatic system and control. Therefore, according to one embodiment, the pneumatic connector to the optional components are coded, such as by RFID or an electronic module in the connector, to communicate the existence and nature of the optional component to the control. The optional component may itself communicate its control and functional characteristics to the control device, or simply provide a self-identification for remote lookup or lookup in a local database. According to another embodiment, the accessory has a code imprinted on it, such as a 2D bar code, which is readable by a camera on the smartphone, which then informs the smartphone of the existence and type of accessory. This data may then be communicate to the control device for subsequent control of the accessory when the smartphone setup device is not present or is inactive.

According to another aspect, the control provides an embedded web server, which interacts with a browser on the smartphone. The smartphone therefore provides a user interface for the server, which itself controls the system. In some cases, the required functionality of the smartphone is built into the control. For example, an Android tablet device may be provided as the user interface, as either a dedicated device or a general purpose device which also includes the required software for interacting with the control.

In order to reduce costs, a simplified valve structure may be provided which employs memory metal (e.g., nickel titanium alloy) which assumes a first physical configuration when heated above a critical temperature, and return to their initial shape when cooled. See A. D. Johnson, "State-Of-The-Art Of Shape Memory Actuators", TiNi Alloy Company, San Leandro, Calif., USA (1998). See also memry.com/sites/default/files/documents/Nitinol_Industrial_Applications_SMST00.pdf, Ming H. Wu and L. McD. Schetky, "Industrial Applications For Shape Memory Alloys", Memry Corporation, 57 Commerce Drive, Brookfield, Conn., Proceedings of the International Conference on Shape Memory and Superelastic Technolgies, Pacific Grove, Calif., P. 171-182 (2000).

Nitinol is a Shape Memory Alloy (SMA) made from Nickel and Titanium. Nitinol demonstrates two distinct types of crystal structure, depending on whether it is above or below its critical transformation temperature. Below that temperature, e.g., between about 104 and 115 degrees F. in this case, Nitinol wire is completely malleable. But once the heat rises, its memory kicks in, and it snaps back to the state in which it was originally "cured". Programming, or annealing, a piece of Nitinol requires holding it in its desired shape while the alloy is heated to and held for a period of time at a very high temperature, e.g., 750 to 900 degrees F. Once it cools, the bendability properties set in, but the memory remains and snaps to any time the structure encounters even much milder heat levels thereafter.

A bleed valve for the heat-sealed bladder may be implemented by providing a layered structure which under normal conditions provides two sheets of elastomeric material in contact, obscuring a potential bleed path. The bladder or pressurized side presses against one sheet, such that the pressure inside the potential bleed path must exceed the external pressure in order for the path to open. A NiTi (Nitinol) wire is provided within the path or within one of the walls. Under normal conditions, the wire is flat, and thus does not disturb the obscured nature of the path. However, when the wire is heated, such as by passing an electrical current through it, it bends out of the plane of the two sheets of elastomeric material, thus effectively increasing the pressure inside the potential bleed path, and permitting pneumatic flow. When the current in the wire ceases, the wire returns to its non-stressed state, and the bleed path closes. Therefore, a relatively low cost, integrated valve structure is provided, controllable by current flow, with at least partial proportional flow control possible.

Alternately, a plurality of pumps may be provided, which in some cases are of lower cost than valves.

Because the communication link and the smartphone are generic, that is, not dedicated in function to the cushion control task, they may provide other functionality as is known. For example, in an Apple iOS device any app from the "app store" can be downloaded, and likewise with an Android device. Various sensors can also be added to the system, and in particular, various physiological sensors for determining the status of the patient in the seat, and physical sensors to sense the status of the seat, may be provided. In some cases, these sensors are connected through the control system for the cushion, but in others they communicate directly with the smartphone to form a personal area network, typically implemented with Wi-Fi (802.11x), Bluetooth (802.15.2), Zigbee (802.15.4), wired Ethernet (e.g., 802.3), USB, RS-232, RS-485, infrared, RFID, and the like. According to one embodiment, a sensor pad is provided which measures the pressure of the seat occupant on the cushion. The sensor pad communicates with the smartphone to communicate the sensor data, which is, for example, pressure data for each square inch of the sensor, which may be 22" by 15", or 330 square inches. A tissue model is implemented to predict ischemic damage to local tissue, and the smartphone automatically generates control signals for the control system to alter the pneumatic pressures in the bladders, which in turn alter the contact pressure on the skin. For example, with two controlled air chambers in the pad, the system might bleed both pads to a relatively low pressure, and after a duration, increase it again. In the case of a paralyzed occupant, some case should be exercised to avoid significantly different heights for the two halves, since this could cause undesirable positional shifting. However, with the auxiliary controls, it may be possible to shift the occupant in an acceptable manner to alter the pressure profile, and thus increase the comfortable sitting time and reduce incidence of injury and tissue breakdown.

While not critically important for comfort or safety per se, the charge state of the battery pack may be monitored from the smartphone, which in turn help schedule charging stops and can also generate an alert when the charging is completed. The smartphone can also monitor battery usage and characteristics, to help predict when the batter pack might need replacement.

The cushion may also be controlled based on the activity of the occupant. When in front of a work surface, the occupant may best have a firm high seat. On the other hand, while riding in the wheelchair, a low soft surface may be best. In some cases, the smartphone can automatically determine the context, though a user interface may provide a selection of different modes.

The auxiliary and optional devices advantageously permit exercise of the lower extremities. This exercise is typically according to a chronological (temporal) cycle. However, the initiation or maintenance of exercise may interfere with other activities. For example, one may not wish to have automated leg extension while riding an elevator or when at a meeting. Therefore, various automated sensors may detect "quiet" conditions during which exercise cycles may proceed, and other conditions in which the exercise is to be deferred. Indeed, to some extent, it is the pump noise which is most intrusive, and the start-stop of the pump and a noisy bleed of the chamber may be distracting. Therefore, in environments where noise is the issue, the system may operate in a "quiet" mode, with reduce compressor noise and slower or quieter bleed operations. The smartphone has a microphone, and the environment may be monitored for ambient noise. Similarly, the smartphone has a camera and GPS, and these may be used to determine a location and visual characteristics of the location, which can then be used to determine or infer context.

When an exercise session is scheduled, the smartphone can generate a warning/prompt to the occupant, who can then accept or reschedule the session. A tissue model for the affected area may help determine the acceptability of delay (or increased frequency for exercise sessions scheduled before the nominal period). Since the pressure on the buttocks and blood flow will depend on leg activity, the seating pad cycles may be interactive with the exercise cycles.

Typically, the battery charge will be sufficient to permit arbitrary usage of the device. However, in some cases, a power conservation mode is required, which minimizes power expenditure within safe and appropriate limits. This mode may be controlled by the smartphone or the control system itself; note that the wireless interface to the smartphone, and the smartphone itself, consumes power, and therefore in a power conservation mode, it may be desirable to avoid use of the advanced interface and rather rely on the automated control within the system.

Pressure sensors may be provided to determine bladder pressure, or bladder wall strain, beneath a bladder to determine a load on a bladder cell, or above the bladder to determine the pressure on an anatomical portion of the supported person. Combinations of sensors is also possible. The pressure sensors may include one or more light transmitters or conductors or optical fibers. The pressure sensors may operate to measure pressure applied to one or more of the bladders. One or more of the pressure sensors may evaluate changes in intensity of light energy diffused within the sensor. Resistive inks may also be used as part of lithographed or printed pressure sensors.

A support layer may be positioned above the inflatable bladders. The support layer may have at least one support characteristic that is different from a support characteristic of the inflatable bladders. The support layer may include a breathable or air-permeable material. The support layer may include resilient portions. The support layer may include projections and depressions. The support layer may be enclosed within an enclosure. The enclosure may be located in the interior region of the cover.

According to one embodiment, the support surface is subject to air ventilation, heating and/or cooling. The circulated air may be at ambient temperature, or may be cooled or warmed in order to achieve desired therapeutic effects. Advantageously, the heating and cooling may be effected by a thermoelectric module, operating from the battery. A 120 VAC adapter may be provided to power the module (and the remaining components of the system, and recharge the battery) when such power is available.

In addition to the electrically controlled valves, a passive pressure relief vale may be provided for each isolated cell, to prevent damage in case of overpressure. The pressure relief valves may be set, for example, at 3 psi.

According to one embodiment, the inflatable cushion provides firm rear and side edges. These may be provided by a dense foam portion, or a region of the cushion having a higher inflation pressure than the central portions. The side and rear edges typically are not occupied during use, and therefore are provided to help center the occupant in the desired seating position. The high pressure may be achieved by a check valve between the occupied region of the cushion and the periphery, which then passively captures the peak pressure.

A standard smartphone as discussed herein is a Samsung Galaxy Note 4 or Galaxy S6, or Apple iPhone 6 plus, the specifications for which are expressly incorporated herein by reference. These smartphones have, for example, a quad core or larger processor, lithium ion battery and charging circuitry, GPU, cellular radio, 802.11n/ac radio, Bluetooth radio, NFC communications, infrared communications, RAM, flash memory, an oLED or LCD screen, touchscreen, optical gesture sensing, microphone, speaker, HDMI port, USB port (3.0), temperature sensor, aGPS, compass/magnetometer, accelerometer, gyroscope, cameras, LED flash, light sensor, pulse sensor, and the like.

The cushion may be connected to the valve manifold through a quick-connect coupling, such as the Colder Products Co. CPC PLC 16004 or PLC 17004 and PLCD22004.

The pump may be a diaphragm or linear pump from Thomas Pumps.

Cooling may be provided in a number of ways. First, heat in an object to be cooled may be lost by transferring heat energy from a hotter mass to a cooler mass, which may be an active, facilitated or conduction process. Second, an artificial gradient may be created to allow heat to be moved effectively from a hotter to a colder mass. This process includes; e.g., compressing a gas to increase its temperature, then shedding the heat resulting from the compression to the environment, followed by decompressing the cooled gas in a different location to a net colder state than prior to compression. Various phase change, e.g., vaporization, solidification, adsorption, dissolution, etc., and irreversible processes may also be used to provide cooling. Thermoelectric junctions may also be used to cool, although their power efficiency is low. See. U.S. Pat. No. 6,865,825, expressly incorporated herein by reference in its entirety. Many systems have been proposed for cooling beverages outside of traditional refrigeration systems, which may be large or clumsy. These past proposals have employed thermoelectric cooling modules (TEMs, employing Peltier junctions), compressed gasses, CFC refrigerants, and endothermic reactions (absorption refrigeration, typically with one solid phase component, such as a zeolite).

The present invention provides a number of different ergonomic intelligent adaptive surface and thermal control embodiments, providing comfort, cooling and/or heating functions. The theory of intelligent adaptive surfaces provides that too high a pressure applied to an area of skin may cause discomfort or produce medical problems. By adjusting the pressure LOQ, applied to an area of skin, a more ergonomic support is provided. See, U.S. Pat. Nos. 5,745,937; 5,713,631; 5,658,050; 5,558,398; 5,129,704; 4,949,412; 4,833,614; 4,467,252; 4,542,547; 3,879,776, expressly incorporated herein by reference. Using a first approximation, the goal of an intelligent support surface is to equalize the pressure applied to the skin along the entirety of the contact area, and to increase the contact area. See, U.S. Pat. No. 4,797,962, incorporated herein by reference. Using sensors, the pressure applied to the skin is measured. Actuators, provided under the surface, deform the surface to adjust the applied pressure and potentially increase the contact patch. See, U.S. Pat. Nos. 5,687,099; 5,587,933; 5,586,557; 5,586,067; 5,283,735; 5,240,308; 5,170,364; 5,060,174; 5,018,786, and 4,944,554, expressly incorporated herein by reference. See also U.S. Pat. Nos. 5,174,424; 5,022,385; A more sophisticated system models the anatomical portion being supported and provides a force distribution map, thereby selectively applying forces over the contact surface. Thus, more sensitive areas are subject to less pressure than less sensitive areas. An even more sophisticated algorithm takes into consideration the time of pressure application, and will adjust the contact force dynamically to, for example, promote circulation.

In particular contexts, the system may be even more sophisticated. For example, in a seating surface, the pressure along the back should not equal the pressure along the seat. However, the optimal conformation of the surface may be more related to the compliance of the surface at any controlled area than on the pressure per se Thus, a highly compliant region is likely not in contact with flesh Repositioning the surface will have little effect. A somewhat compliant region may be proximate to an identifiable anatomical feature, such as the scapula in the back. In this case, the actuator associated with that region may be adjusted to a desired compliance, rather than pressure per se. This provides even support, comparatively relieving other regions. Low compliance regions, such as the buttocks, are adjusted to achieve an equalized pressure, and to conform to the contour of the body to provide an increased contact patch. This is achieved by deforming the edges of the contact region upwardly until contact is detected. The thigh region employs a hybrid algorithm, based on both compliance and pressure.

An adaptive intelligent surface need not be limited to the control of surface contour. Thus, the surface contour, local compliance and local damping may all be controlled. Thus, for example, the dynamic aspects of the control may all be subject to closed loop electronic control; however, for a large number of actuators, this may be expensive and/or difficult. Alternately, the contour may be set with a hydraulic actuator, having a relatively low update frequency. The compliance may be adjusted, for example, by providing a controlled ratio of air and fluid in a hydraulic system feeding the actuator; the damping factor may controlled by an additional proportional valve which adjusts a bleed rate. Therefore, a dynamically adjustable surface may be constructed.

As discussed below in more detail, the seating surface may be cooled, for example by the flow of cool air, or a heat exchanger beneath the seating surface. The heat exchanger may be primary, i.e., absorb heat in a primary refrigeration cycle, or secondary, i.e., transfer heat through a heat exchange medium to a primary heat exchanger. Advantageously, common elements of the system for cooling the seating surface are also used to heat the surface, as appropriate. Thus, hot or cold air may be directed to the seating surface, which is, for example, a cloth or other open surface. Where a heat exchanger is provided, the heat exchange fluid may be heated or cooled, as appropriate, to control the seating surface temperature. This is readily implemented easier with a secondary heat exchange system, wherein the secondary heat exchange fluid is either heated or cooled, for example by taps from a vehicular heating and air conditioning system In a primary heat exchange system, refrigeration proceeds by a normal cycle, in which a volatile refrigerant evaporates within the heat exchanger to cool the surface. To heat the surface, a refrigerant-compatible oil is circulated through the same heat exchanger, with the refrigerant gas stored compressed in a reservoir. The refrigerant may be drawn from a vehicular air conditioning system or a separate system, while the heating may be electrical or derive from a heat source within the vehicle. It is noted that a seating surface according to the present invention need not be associated with a vehicle, and therefore the control system, heating and/or cooling may be independent. Where a volatile refrigerant gas is present in the seat, the actuators for an intelligent surface may employ this gas, which is pressurized, for displacing the actuators.

The seating surface may include, for example, a thermally conductive gel layer, e.g., HeatPath thermally conductive gel CTQ 3000 from Raychem, Menlo Park, Calif. This gel provides both thermal conductivity and compliance.

According to the present invention, a high tensile flexible strength polymer film is preferably employed in fabricating bladder structures. These films, which are, for example, polyester (Polyethylene Phthalate polymer), although other films may be employed. The preferred polyester films have a modulus per ASTM D882 of about 550 kpsi, making them relatively stiff. Therefore, when heat sealed to form a bladder structure or fluid (gas or liquid) flow path, the walls are relatively non-compliant, even with relatively thin films, for example 50 gauge, of course, the selected film thickness will depend on the desired mechanical properties and vapor diffusion limits. Thus, in contrast to prior designs which employ polyurethane or poly vinyl chloride films to form bladder structures, the preferred polyester films according to the present invention may be pressurized to relatively higher levels to allow a finer degree of control over the contour of the shoe. Of course, if the bladder pressure is relatively high, padding should be separately provided. This high pressure containment capability also allows the bladder structure to withstand greater transient pressures without failure or requiring a relief valve, even where inflated or pressurized to a lower pressure. Suitable films are readily heat sealed, to with a strength of, for example, greater than 400 g/in.

The first step in providing an adaptive control system is to provide appropriate sensors to detect the status of the condition to be sensed. There are typically two control strategies; first, actuators and sensors are paired, with the sensor measuring very nearly the variable altered by the actuator, allowing simplified closed loop control over the operation of each actuator, and a distributed sensor network with no one-to-one relationship with the actuators. According to the present invention, both strategies are employed in various portions of the system.

In a multizone cushion, the effect of the various zones on the occupant may be interactive, i.e., the controlled parameter is sensitive to a plurality of actuators (bladders, pistons, etc.), and each actuator will have effects outside its local context. Therefore, in order to achieve a desired conformation, the actuators must be controlled in synchrony. While it may be possible to sequentially adjust each actuator without a priori determining the interaction, this may result in oscillation and prolonged settling time, discomfort, and waste of energy. Therefore, the microcontroller executes a predictive algorithm which estimates the interaction, and precompensates all affected actuators essentially simultaneously. As discussed herein, a preferred embodiment employs a sequential multiplexed valve and compressor structure. Therefore, as each valve position is sequentially achieved, an appropriate compensation applied. The predictive algorithm need not be perfect, as the effect of each compensation step may be measured using the sensor array, and thus the actuator controls may be successively refined to achieve an optimal configuration.

In a first order approximation, at least, the effects of actuators will be superposable. Further, each actuator will typically have a control function which approximates the function $f(x)=\cos(\omega_x)e^{-bx}$, where x is the absolute distance from the actuator center, ω is a periodic spatial constant and b is a decay constant. The resulting function therefore provides a long range effect of each actuator, which is periodic over distance. The interactivity of actuators may be analyzed using a Fourier type analysis or wavelet analysis. The actuators are intentionally made interactive; if there were no interactivity, there would necessarily be a sharp cutoff between actuator zones, which would likely cause discomfort and surface discontinuities, or the zones would be spaced too far apart to exert continuous control. By spatially blending the actuator effects, spatially smooth control is possible.

One type of microvalve structure employs a nickel titanium alloy "shape memory alloy" ("SMA") actuator to control flows. See U.S. Pat. Nos. 5,659,171; 5,619,177; 5,410,290; 5,335,498; 5,325,880; 5,309,717; 5,226,619; 5,211,371; 5,172,551; 5,127,228; 5,092,901; 5,061,914; 4,932,210; 4,864,824; 4,736,587; 4,716,731; 4,553,393; 4,551,974; 3,974,844, expressly incorporated herein by reference. Such a device is available from TiNi Alloy Co. (San Leandro, Calif.). See "Tini Alloy Company Home Page", www.sma-mems.com/nistpapr.htm; "Thin-film TI-NI Alloy Powers Silicon Microvalve", Design News, Jul. 19, 1993, pp. 67-68; see also "Micromechanical Investigations of silicon and Ni—Ti—Cu Thin Films", Ph. D. Thesis by Peter Allen Krulevitch, University of California at Berkley (1994); MicroFlow, Inc. (CA) PV-100 Series Silicon Micromachined Proportional Valve. In these systems, an electric current is controlled to selectively heat an actuator element, which non-linearly deforms as it passes through a critical temperature range, which is typically between 50°-100° C. Thus actuator unseats a valve body, controlling flow. The memory metal actuator may be formed by a vapor phase deposition process and then etched to its desired conformation. The actuator has relatively low power requirements, e.g., 100 mW per element, and is capable of linear flow modulation. The response time is about 1 mS to heat, and 1-10 mS to cool, depending on the ambient temperature and heat capacity, e.g., whether the environment is liquid or gas. The system may be readily formed into microarrays. Importantly, the system readily operates at logic switching voltage levels, facilitating direct interface with electronic control circuitry. An array of selectively operable microvalves may be present.

The cushion and attachments are preferably formed of a urethane coated nylon cloth which is formed into a bladder by the use of radio frequency sealing. The Nylon cloth is preferably between 100-1000 denier. The nylon is most preferably 200 denier, with a water repellent outer finish. The radio-frequency sealing process joins two or more sheets in parallel planes by passing a radio-frequency or microwave signal through the layers, causing localized heating in the layers in a pattern conforming to the antenna-applicators, also referred to as RF sealing dies. If materials other than urethane are used, then other known sealing or fusing the layers may be applicable. These methods include heat sealing, laser sealing, adhesives, pressure sealing, sewing and the like. This localized, patterned heating from an RF sealing process causes the polyurethane coating of the nylon mesh to fuse with adjacent layers. On cooling, the fused portions form a hermetic-type seal.

A pressure sensor may be, for example, an air pressure sensor, a force sensing resistor, a pressure responsive capacitive sensor, or other known type. A force sensing resistor may be constructed, for example by providing a compressible polymer loaded with tin oxide, available commercially from Interlink Electronics, Inc. A force sensing capacitor may be constructed by forming conductive electrodes on the surface of a compressible dielectric, for example a polyurethane foam. The electronic control may also be used to provide an alarm indication if bladder exceeds a desired pressure or if a relief valve malfunctions.

The connectors for hoses to and from the device are available from, e.g., Colder Products Corp., St. Paul, Minn. ("Two way Shutoff Valves") and Qosina Corp., Edgewood, N.Y. The refrigerant supply tube is, for example, a ⅛' ID tube. An electrical continuity connector may also be provided to sense disconnect, which may also carry another sensor signal.

The compressor is preferably driven from a 12 VDC motor, driven by a motor control. The motor control may be for example, a PWM modulated MOSFET, IGBT or bipolar device, controlled by flow rate, back pressure in a manifold, time and compressor characteristics, or other known means.

The device may provide an automatic oscillation or alternating pressure for the respective bladders. For example, if the cushion is divided into at least three pressure bladders, a timing mechanism may be provided that causes a periodic wave wherein one or more of the bladders has a reduced pressure for a few seconds. The timing mechanism may be, for example, a solenoid operated relief valve (one for each chamber) or a rotary relief valve with multiple positions, driven by a solenoid and ratchet mechanism. The state of the relief valve is controlled by the control device, synchronized with operation of the compressor.

It is noted that the accessory attachments will typically be used for exercise, and these will benefit from direct control, and thus are preferably provided with a separate relief valve for each. However, the exercise may also be controlled according to a cycle. These attachments are used, for example, to provide passive exercise by lifting each lower leg from the bent to the straightened position. The attachments may also facilitate active exercise, by, for example, providing a cushion against which the occupant can flex the knee, for example with feedback of the amount of force provided in each leg. For extension exercise, the attachment can servo against the dorsal surface of the leg, and prevent abrupt dropping of the limb, which could cause bruising. The servo force may also guide the occupant during a desired course of exercise.

An adaptive seating surface is provided having a controllable surface contour, optional controllable temperature, and optional controllable dynamic response. The seat provides ergonomic advantages and improved performance. The contour of the seating surface is adjusted by pneumatic actuators beneath the seating surface. These actuators are provided to correspond to anatomic regions, and are controlled on the basis of a physiological model of the seated body, a comfort model, and a sensor array near the seating surface. A single control system manages the sensors and actuators, although multiple cellular processors, each controlling an actuator and receiving inputs from neighboring sensors and other cells, may also be implemented.

One type of pressure/load sensor for the seating surface provides a polyurethane layer, which is metalized on one side, preferably the upper side, and formed as an array of separate conductive zones on the other side. The polyurethane may be, for example, a Sorbothane type mechanical shock absorbing polymer. The separately conducting zones are used, with the polyurethane layer and metalized side as a capacitive sensor, responsive to an applied pressure. In place of the polyurethane layer, other specially thermally conductive dielectric layers, such as Raychem HeatPath thermally conductive gel CTQ 3000 may be used. The conductive zones are each contacted by a conductive pad, through an apertured insulator sheet, to a planar flexible circuit. The planar flexible circuit may have thermal sensors, for example thermistors or semiconductor junction sensors. The planar flexible circuit interfaces through cable to the control system.

According to one embodiment, the control seeks to adjust the pressures within the various bladders to achieve uniform forces over analogous anatomical parts, although a cycling of pressures or other asymmetry may also be provided. For weight bearing portions, such as the buttocks, the system evenly distributes the forces and damps significant transients. For the back, lumbar support may be is provided, though the forces are not equalized with the buttocks. The thighs are supported, and the pressure exerted may be based on user preference, seating position, a history of movements, and dynamic forces. A headrest optionally includes actuators as well, and is preferably resilient, but absorbs shocks in the event of a high intensity transient. The seating position is controlled by user control, which also receives user preferences for adaptive seating system control.

In particular contexts, the system may be even more sophisticated. For example, in a seating surface, the pressure along the back should not equal the pressure along the seat. However, the optimal conformation of the surface may be more related to the compliance of the surface at any controlled area than on the pressure per se. Thus, a sensed highly compliant region is likely not in contact with flesh. Repositioning the surface will have little effect. A somewhat compliant region may be proximate to an identifiable anatomical feature, such as the groin. In this case, the actuator associated with that region may be adjusted to a desired compliance, rather than pressure per se. This provides even support, comparatively relieving other regions. Low compliance regions, such as the buttocks, are adjusted to achieve an equalized pressure, and to conform to the contour of the body to provide an increased contact patch. This is achieved by deforming the edges of the contact region upwardly until contact is detected. The thigh region may employs a hybrid algorithm, based on both compliance and pressure.

It is noted that, due to shift in center of gravity and moment of inertia, during exercise, the optimal state of the seating cushion will vary according to the angle of the knee. Therefore, as the knee is extended, the center of gravity shifts forward, and to compensate, the front of the thigh should be to be elevated and the supporting surface made stiffer, as compared to the coccyx region.

It is therefore an object to provide an inflatable seat cushion device, comprising: a power source; at least one air compressor; a distribution manifold configured to receive compressed air from the at least one air compressor, and to selectively distribute the compressed air to a plurality of ports; a mechanism to selectively relieve a pressure at the plurality of ports; a plurality of inflatable chambers, each having a flexible wall, a conduit communicating air with a respective port, each inflatable chamber having a pressure responsive to an amount of air within the respective inflatable chamber, the plurality of inflatable chambers comprising at least a pair of thigh support chambers, and at least one buttocks support chamber; at least one auxiliary chamber configured, when inflated, to extend the knee of an occupant of the inflatable seat cushion device, and when deflated, to permit flexion the knee of the occupant of the inflatable seat cushion device; and a control device, configured to control the distribution manifold and the at least one air compressor, having a communication interface configured to receive control information for controlling an operation of the air compressor and distribution manifold over time and a memory configured to store the received control information.

The power source may comprise a solar panel or an electric wheelchair battery, for example.

The at least one air compressor may comprise a plurality of air compressors, which may operate in parallel, in series or concurrently.

The device may further comprise a pressurized air accumulator, configured to receive compressed air from a respective air compressor and to supply compressed air to the distribution manifold when the respective air compressor is inactive. One or more of the inflatable chambers may serve as an accumulator for another of the inflatable chambers.

The distribution manifold may comprise a plurality of electrically operated valves.

The mechanism may comprise a plurality of electrically operated relief valves.

The device may further comprise an electrically operated valve which selectively communicates between two inflatable chambers, e.g., balances a pressure between the cushions.

The device may further comprise an electrically operated air pump configured to selectively transfer air between two inflatable chambers.

The at least one auxiliary chamber may comprise a tubular inflatable structure configured to extend horizontally from a seating surface when inflated. The at least one auxiliary chamber may also comprise a pneumatic piston.

The communication interface may comprise at least one IEEE-802 series standard protocol, i.e., 802.11X (wireless networking, e.g., WiFi), or 802.15 (personal area network, e.g., Bluetooth, Zigbee).

It is another object to provide a method of operating an inflatable seat cushion device, comprising: providing a plurality of inflatable chambers, each having a flexible wall, a conduit communicating air with a respective port, each inflatable chamber having a pressure responsive to an amount of air within the respective inflatable chamber, the plurality of inflatable chambers comprising at least a pair of thigh support chambers, and at least one buttocks support chamber; providing at least one auxiliary pneumatic device configured, when inflated, to extend the knee of an occupant of the inflatable seat cushion device, and when deflated, to permit flexion the knee of the occupant of the inflatable seat cushion device; receiving compressed air from at least one air compressor, and selectively distributing the compressed air to a plurality of respective ports, and relieving a pressure at a selected one of the plurality of ports, to thereby inflate and deflate the plurality of chambers; storing received control information in a memory; and controlling the at least one air compressor and at least one relief device over time with a control device to inflate and deflate the plurality of inflatable chambers.

The control information may be received through a communication interface according to at least one IEEE-802 series standard protocol.

The at least one air compressor may comprise a plurality of air compressors, further comprising operating at least two air compressors concurrently or sequentially.

The method may further comprise receiving compressed air from a respective air compressor into an air accumulator and supplying the compressed air from the accumulator to the distribution manifold when the respective air compressor is inactive.

The method may further comprise controlling a flow of air into, out of, or between inflatable chambers by the control device with at least one valve or air pump.

The method may further comprise supplying compressed air to a pneumatic actuator at a pressure of at least 3 psi to operate the at least one auxiliary chamber.

It is a still further object to provide a pneumatic lower extremity exercise device, comprising: a power source; at least one air compressor; a pressure relief mechanism; at least one pneumatic device configured, when subject to air pressure from the at least one air compressor, to extend the knee of a subject, and when deflated, to permit flexion the knee of the subject; and a control device, configured to control the at least one air compressor and the relief mechanism, having a communication interface configured to receive and store control information for controlling an operation of the air compressor and the pressure relief mechanism over time.

DETAILED DESCRIPTION OF THE INVENTION

Figure 1:
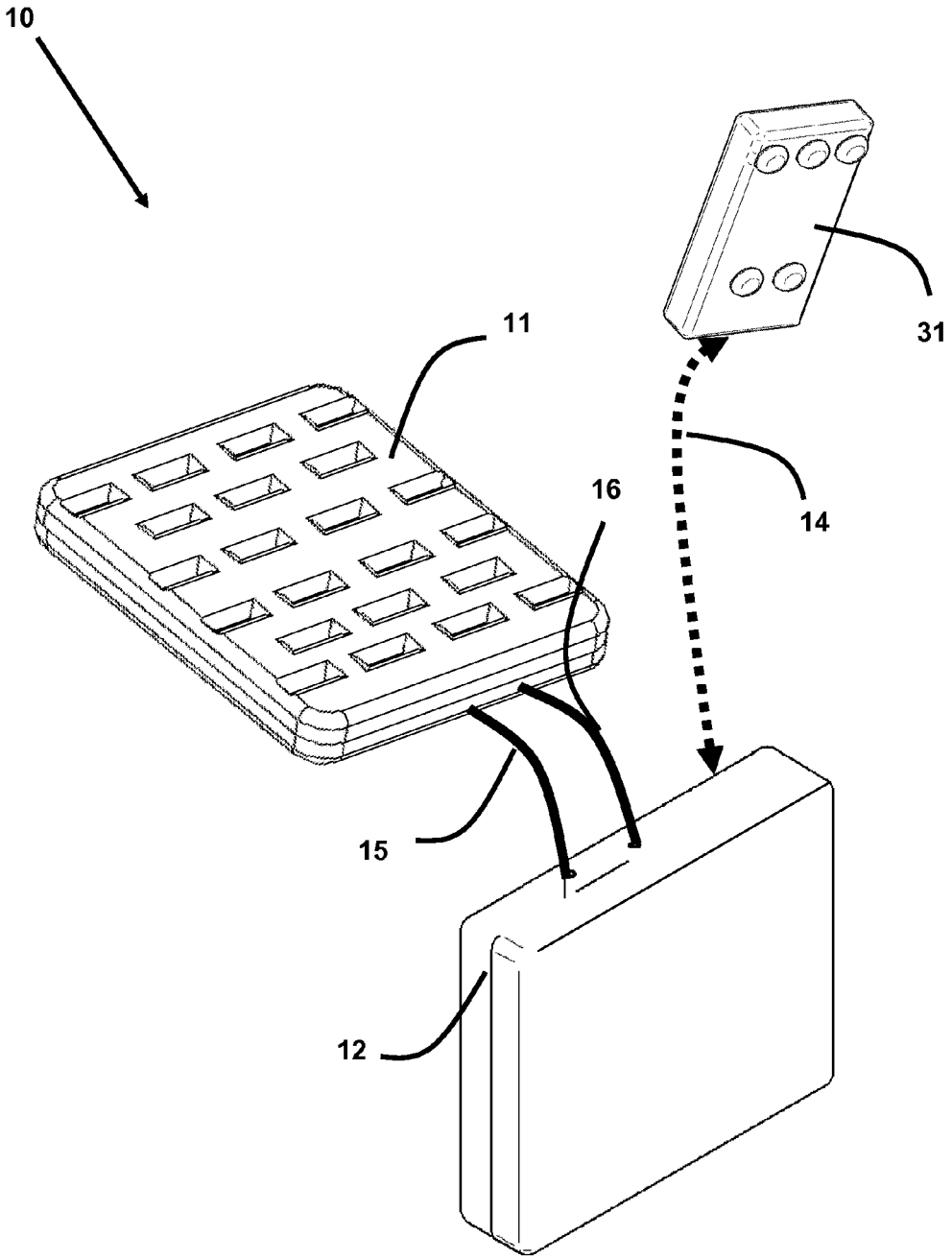
FIG. 1 is a perspective view of a portable pneumatic seating device of the present invention.
Figure 2:
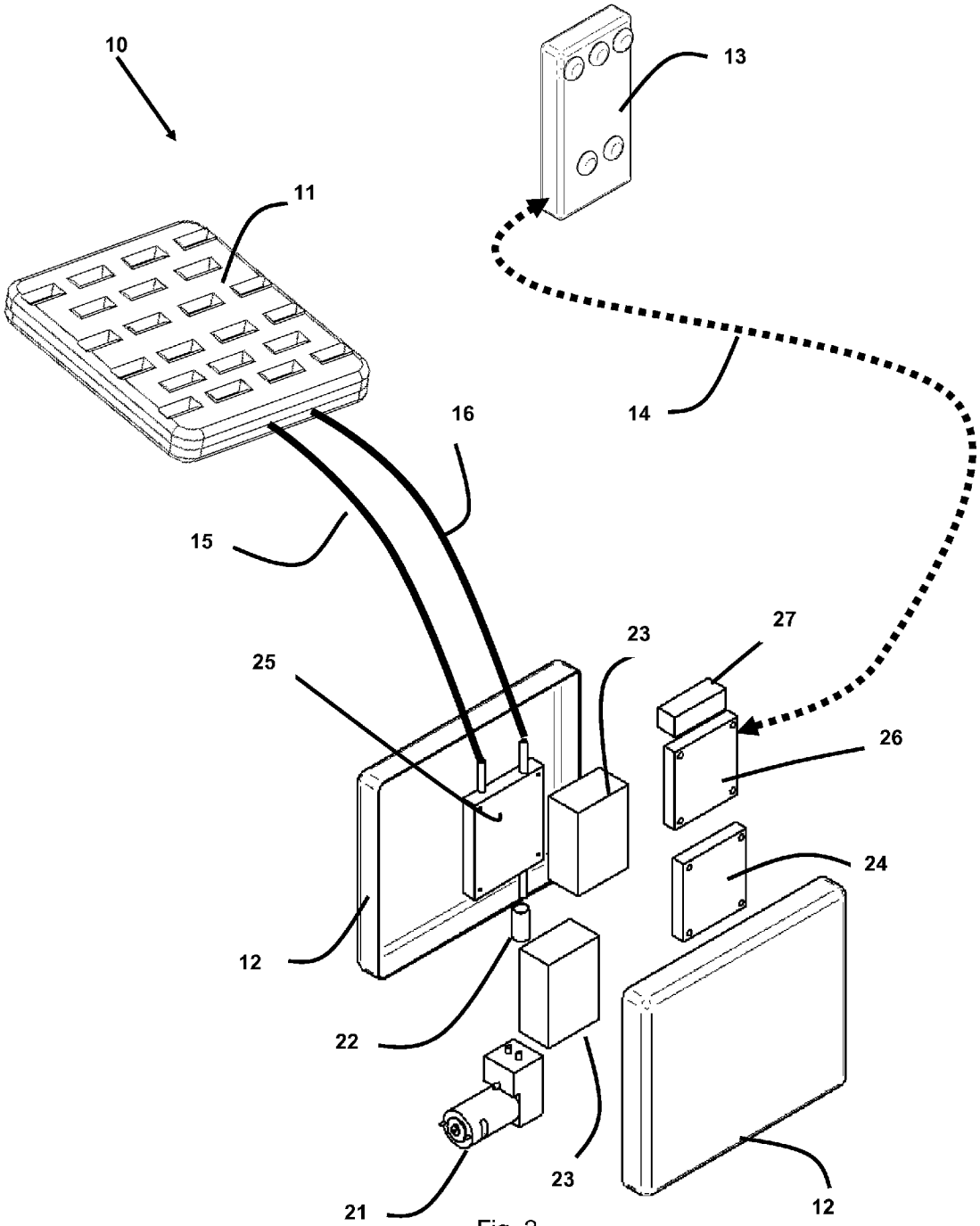
FIG. 2 is a detailed component view of a portable pneumatic seating device of the present invention.

Referring now to the invention in more detail, FIGS. 1-4 show a portable pneumatic seating device 10 positioned in either a substantially horizontal or vertical position. The pneumatic seating cushion 10 is controlled by a remote control module 13, controller module 12, pneumatic tubes 15 and 16, pneumatic pad module 11, and communication process 14, which are provided within or attached to a housing.

In further detail, still referring to the invention of FIGS. 1-4, the portable pneumatic seating device 10 contains pneumatic pad 11 connected to pneumatic tubes 15 and 16 which are connected to valve module 25, connected to compressor module 21 with a coupler module 22. A receiver and digital processor module 26 is connected to the valve module 25, with power module 23 connected to the compressor module 21, receiver and digital processor module 26 and power management module 24. An emergency notification module 27 is connected to receiver and digital processor module 26. The remote control module 13 communicates functional operational commands to receiver and digital processor module 26 using radio frequency (e.g., WiFi, Bluetooth, digital cellular, etc.), infrared, light, ultrasound, through the communication process 14. A wired connection is also possible.

The receiver and digital processor module 26 provide electrical and electromagnetic control to the valve module 25 which, in turn, controls the activation or deactivation of the compressor module 21, causing pressure to be sent to, or removed from, pneumatic pad module 11, having pneumatic modules 31, 32, and 41.

Pneumatic modules 31, 32, and 41 are preferably controlled independently of pneumatic module 11. Further modules may also be provided, such as an extension 42 beyond pneumatic module 32. In this configuration, pneumatic modules 31 and 32 provide cushioning below the thighs, independent of the buttocks, forming a three-segment seating cushion. The extension pneumatic module 41 is operated separately from the other inflatable modules, and can be actuated to extend the right knee, to provide exercise and to maintain joint flexibility. Similarly, the extension pneumatic module 42 is also operated separately, and can be actuated to extend the left knee. The inflation cycles of the pneumatic modules 41 and 42 are controlled by the controller module 12.

Figure 14A:
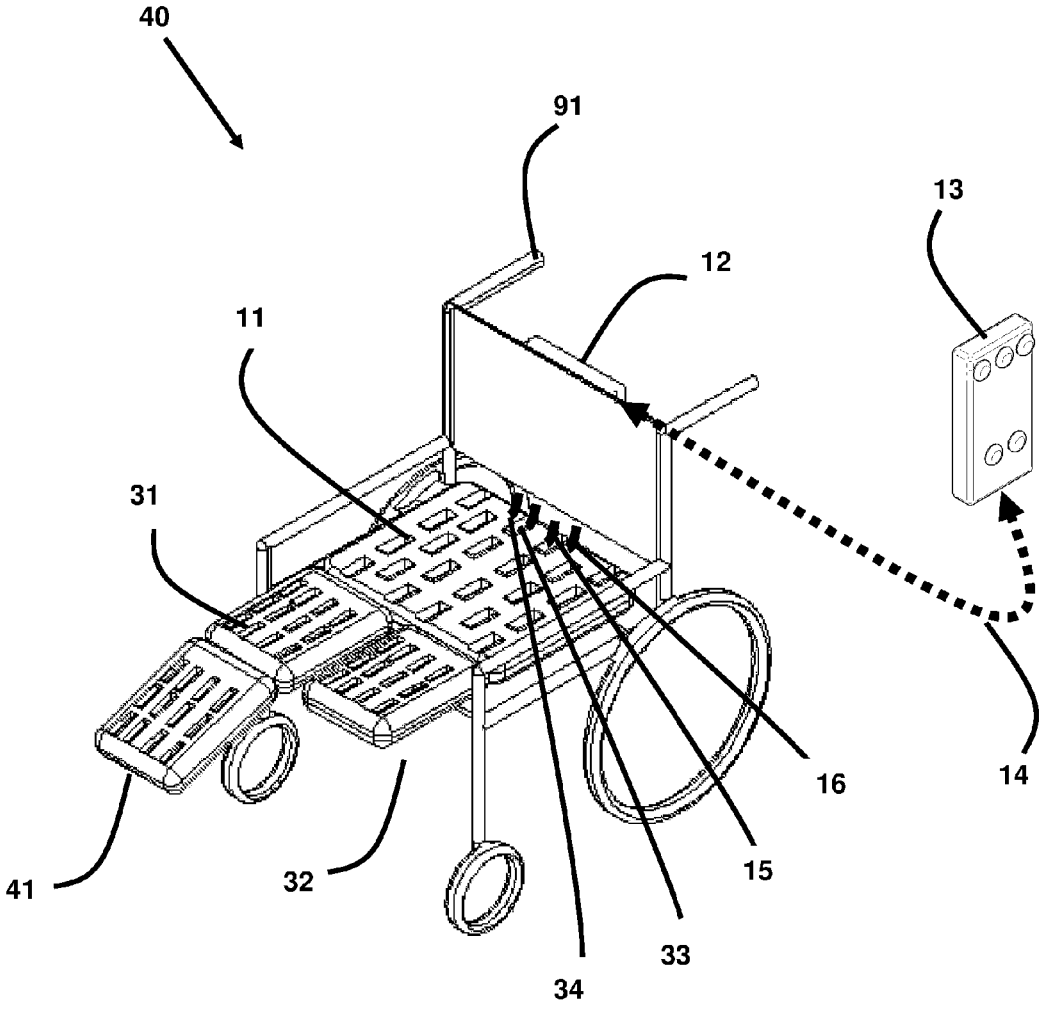
FIGS. 14A, 14B, 14C and 14D show four embodiments of a front view of staggered plurality of portable pneumatic pad platform seating devices of the present invention used on a common wheelchair, wherein FIGS. 14B, 14C and 14D have different leg lift technologies.
Figure 14B:
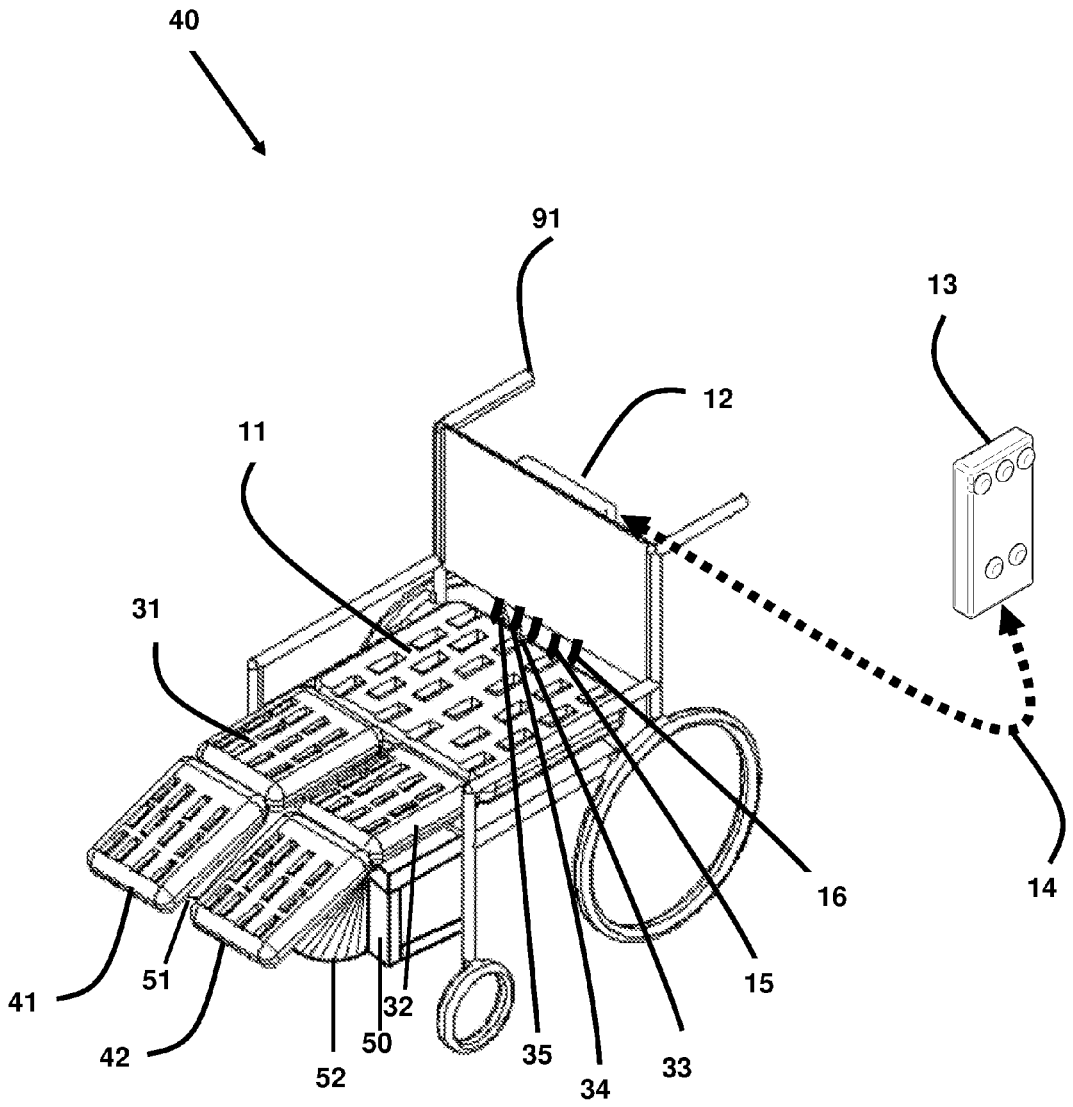

The extension pneumatic modules 41 and 42 may operate in various manners. If a fixed surface 50 is provided behind the pneumatic module 41, 42, as shown in FIG. 14B, and especially if the pneumatic module 41, 42 has a wedge shape or bellows-type extension 51, 52, as the pneumatic module 41, 42 is inflated and the pressure increases, the wedge or bellows will press against the fixed surface 50, causing a physical movement of the front/top surface of the pneumatic module, lifting the respective lower leg of the occupant. The fixed surface 50 may be a cross-bar or kick-plate of the wheelchair.

Preferably, the rear/lower surface of the pneumatic module 41, 42 is rigid, for example, a plastic or fiberglass plate with curved peripheral edges, forming a bowled inner surface. This plate may be provided interior or exterior to the bladder of the pneumatic module. In the case of an internal plate, no hermetic sealing is required around the edge. The plate may also form the rear surface of the pneumatic module, in which case hermetic sealing may be required. The plate may also be provided as an exterior attachment to the sealed bladder.

Figure 14C:
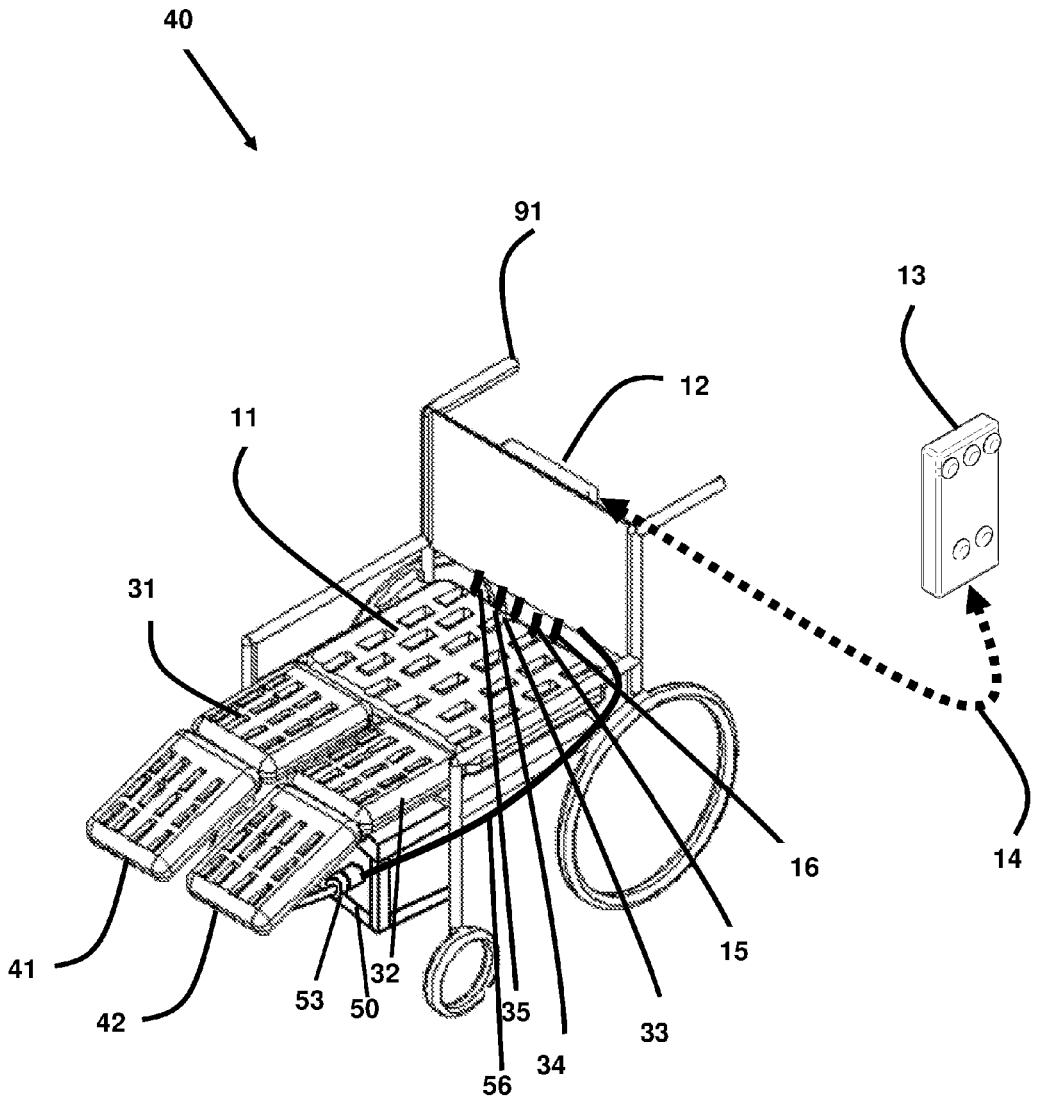

A first alternate implementation of the pneumatic module provides a piston/cylinder 53 which is inflatable through tube 56 to a higher pressure than the occupant contact surfaces, as shown in FIG. 14C. Thus, while the occupant contact surfaces are generally inflated to less than 2 psi, the piston/cylinder 53 which acts against the surface 50, can be pressurized up to about 30 psi (2 atmospheres) by a generally available compressor. Under pressurization, the piston will extend from the cylinder, and push the pneumatic module 42 upward (and a corresponding piston and cylinder, not shown, push the pneumatic module 41 upward), and thus lift the lower leg.

Figure 14D:
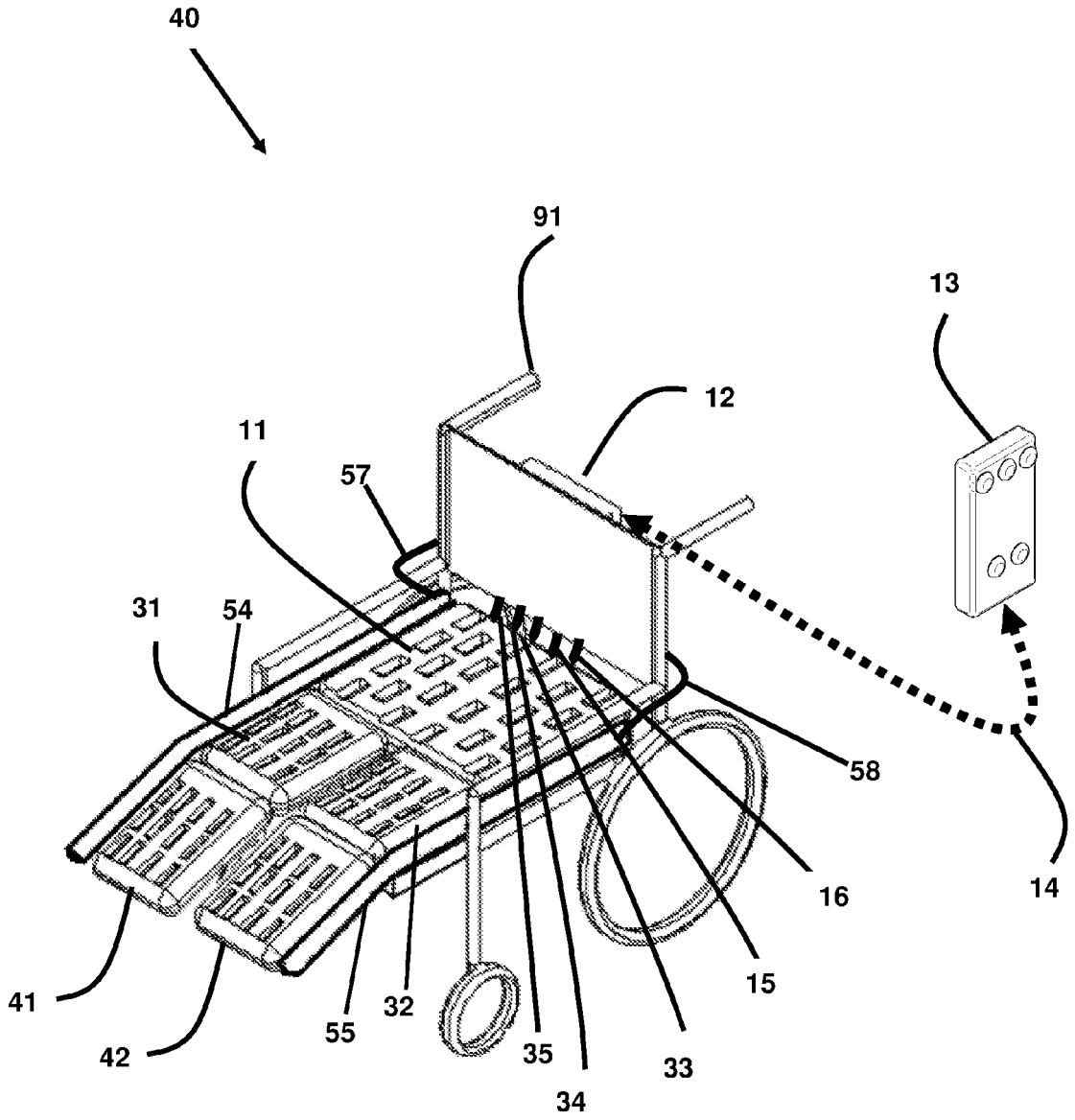

A second alternate implementation of the pneumatic module provides a pair of tubes 54, 55 which are inflatable through tubes 57, 58 to a higher pressure than the occupant contact surfaces, as shown in FIG. 14D. Thus, while the occupant contact surfaces are generally inflated to less than 2 psi, the tubes 54, 55 can be inflated up to about 30 psi (2 atmospheres) by a generally available compressor. The tubes 54, 55 may be formed of a fiber reinforced flexible wall polymer (similar in construction to a garden hose), under such inflation will tend to straighten, and carry the pneumatic modules 41, 42 upward, and thus lift the lower leg when extending horizontally from the lateral side of pneumatic modules 31 and 32 (i.e., lateral to the sitting position of the occupant).

Similarly, a pair of concentric tubes with a bellows inside will extend when inflated, and may be spring or elastic loaded to retract when the pressure is removed. Such an actuator is located beneath the wheelchair seat or lateral to the occupant seating position, and in the retracted state, permits the pneumatic module 41, 42 to drop, causing flexion of the knee. In the inflated state, the actuator extends and lifts the pneumatic module 41, 42 to the extended knee position.

It is noted that in the tube or piston/cylinder embodiments, the actuator pressure is different than the occupant contact pressure; advantageously, the pressure in pneumatic module 41, 42, may be the same as the pressure in the respective pneumatic module 31, 32, and thus may be operated by the same valves.

The controller module 12, in turn, is controlled through the communication process 14 by a remote control module 13, which may be a smartphone device, which executes an app (application program) to provide its operative intelligence. The controller module 12 or the app, or both, may provide security to prevent unauthorized access, control or data downloads to or from the controller module 12. The app permits communication with a remote server through a cellular communication network, with a remote server. In the case of a medically prescribed exercise regimen, the app can communicate securely with a medical server, to download the regimen, and report back to the physician compliance with and/or the results of the regimen. The physician can then change the regimen as appropriate, by communicating through the medical server. The user can also control various functionality of the system through the smartphone interface app. It is noted that the remote controller module 12 need not be a smartphone per se, though a smartphone typically provides all of the required support for basic and optional functionality required by the system.

The controller module 12 housing may be made of any sufficiently rigid and strong material such as high-strength plastic, steel, aluminum, fiberglass, composite, carbon fiber or the like, and may be machined, formed, stamped, molded, extruded, or the like. Further, the pneumatic pad 11 can be made of any sufficient flexible, air retention fabric that can be sealed together using chemical, thermal, ultrasonic, RF, passive or electro sealing processes. Such fabrics include nylon reinforced polyurethane, and other thermoplastic films that can be bonded sealed together to achieve a high tensile strength.

Figure 3:
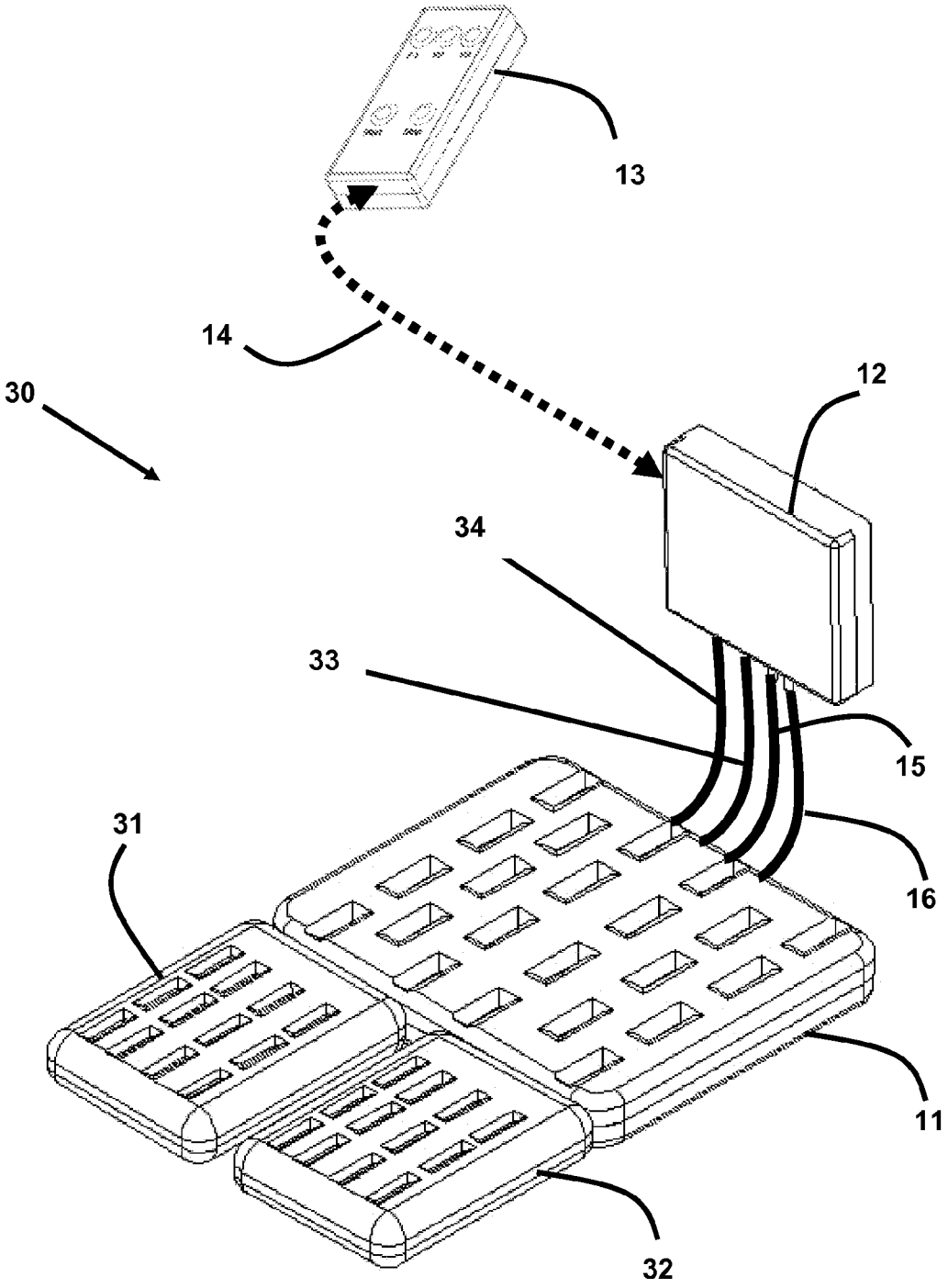
FIG. 3 is a perspective view using three portable pneumatic pad platform seating devices of the present invention.
Figure 4:
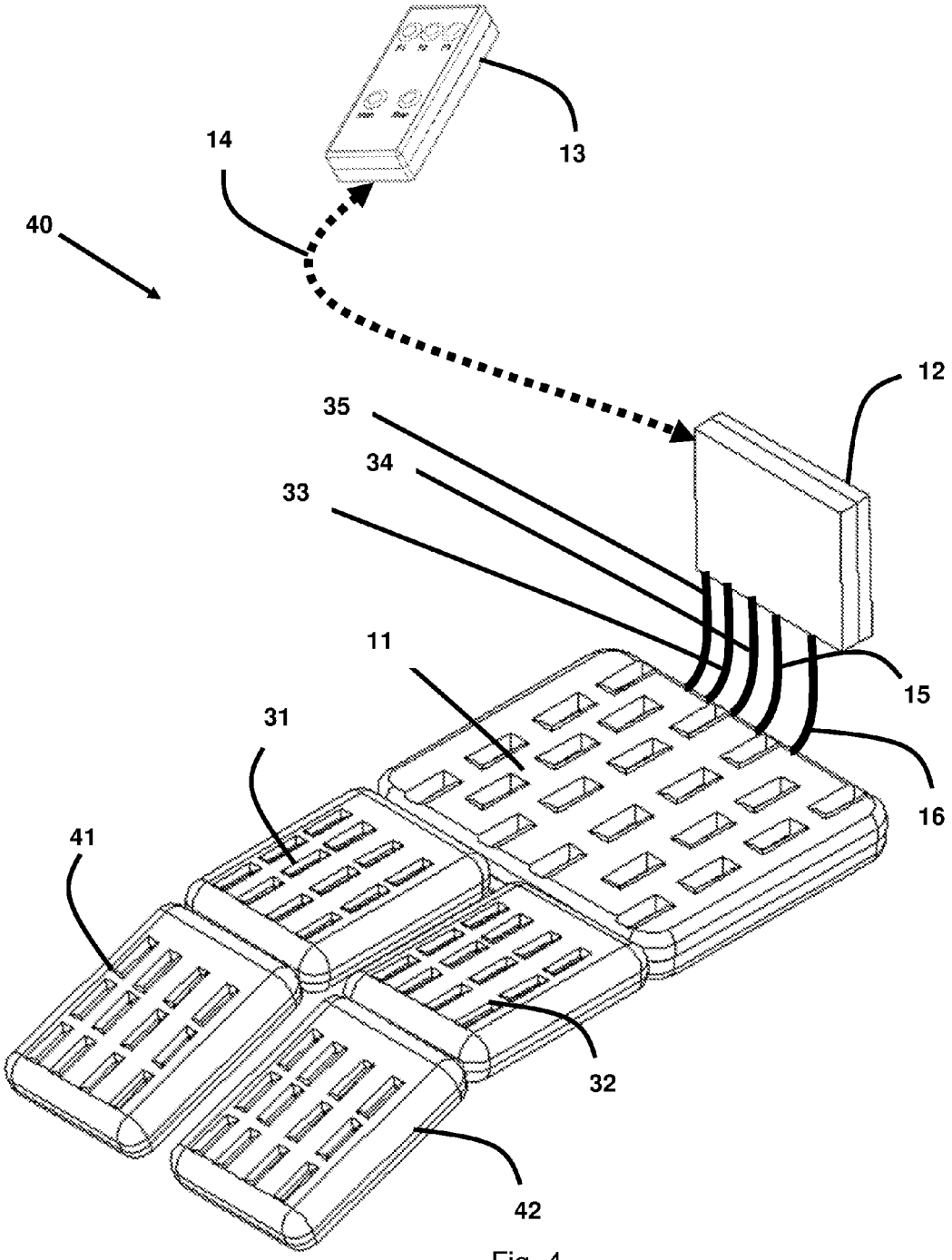
FIG. 4 is a perspective view using a plurality of portable pneumatic pad platform seating devices of the present invention.

Referring now to FIGS. 3 and 4 there is shown a portable pneumatic seating device 30 or portable pneumatic seating device 40 positioned in a substantially horizontal position controlled by remote control module 13, controller module 12, pneumatic tubes 15, 16, 33, 34, pneumatic pad module 11, pneumatic pad modules 31, 32 and 41, and communication process 14. The controller module 12 of the portable pneumatic seating device 30 communicates functional operational commands through communication process 14. Controller module 12 supplies or removes pneumatic pressure to pneumatic pad module 11 and pneumatic pad modules 31, 32 and 41, via pneumatic tubes 15, 16, 33, 34. To supply pneumatic pressure, compressor module 12 is run, and a respective valve within the valve manifold is opened, resulting in air flow to a respective chamber. To remove pneumatic pressure, a relief valve is opened, that allows air to bleed from the respective chamber. The design is such that one pneumatic pad module may be inflated concurrently with another being deflated.

Figure 5:
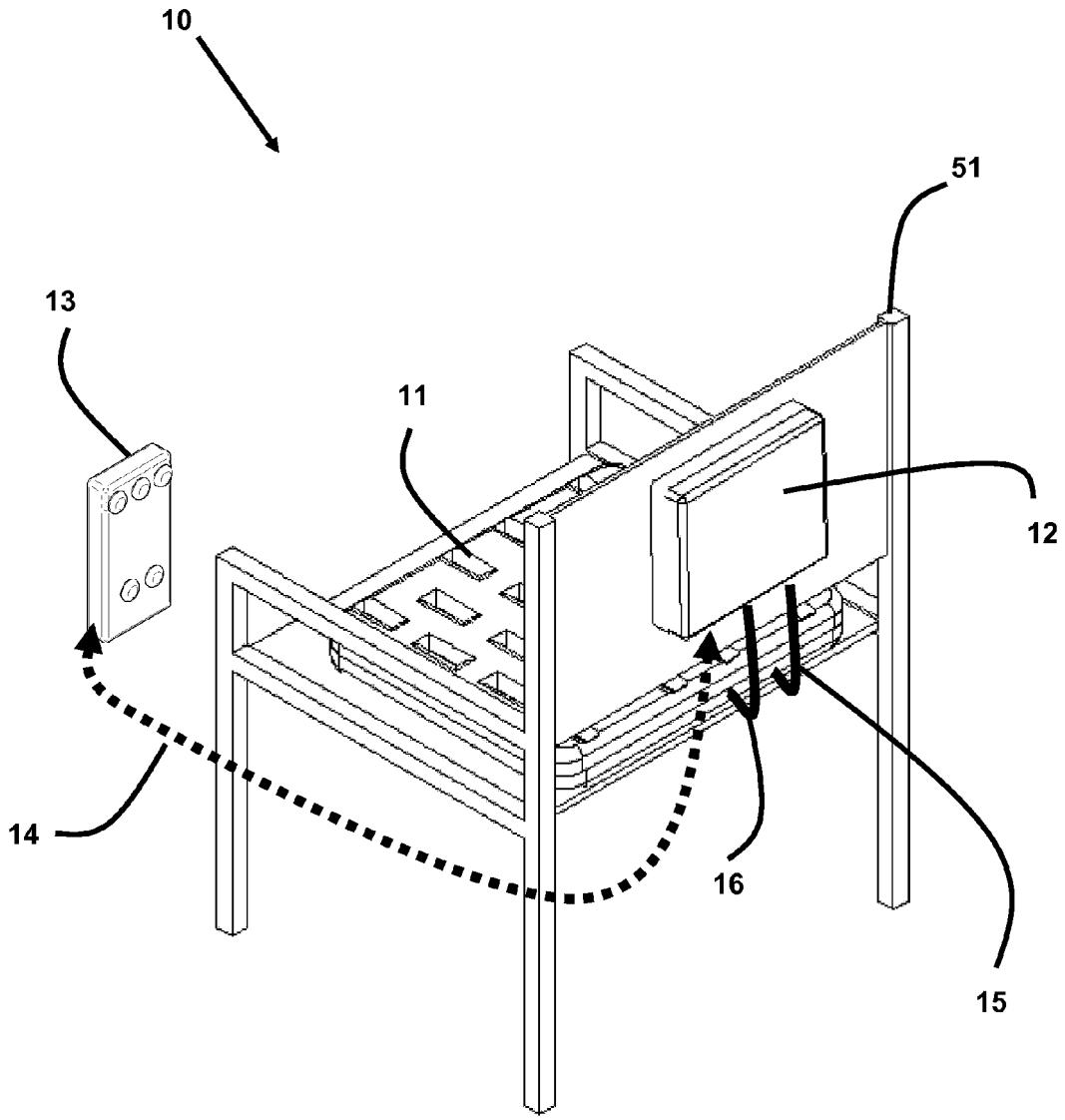
FIG. 5 is a rear perspective view of a single portable pneumatic pad platform seating device and of the present invention used on a common chair.
Figure 6:
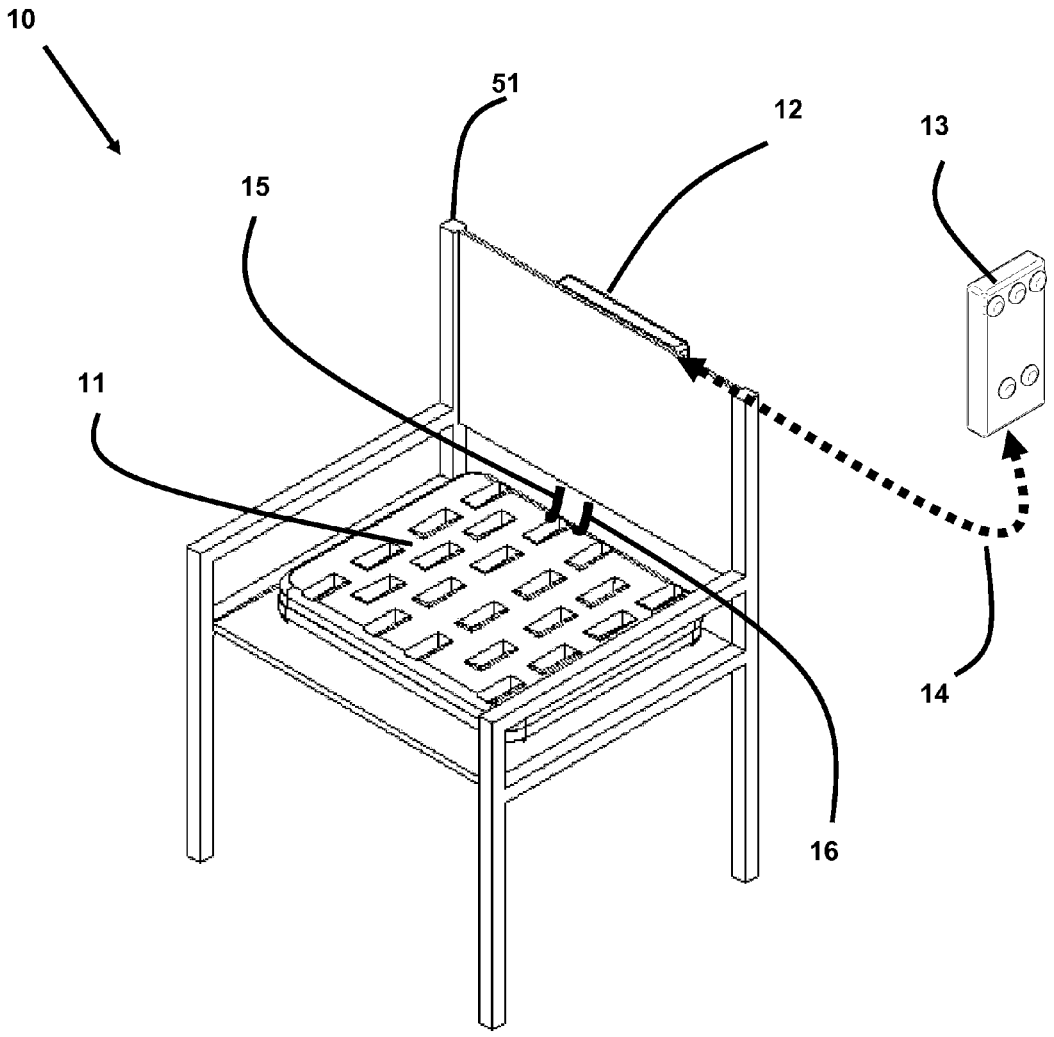
FIG. 6 is a front perspective view of a single portable pneumatic pad platform seating device of the present invention used on a common chair.
Figure 7:
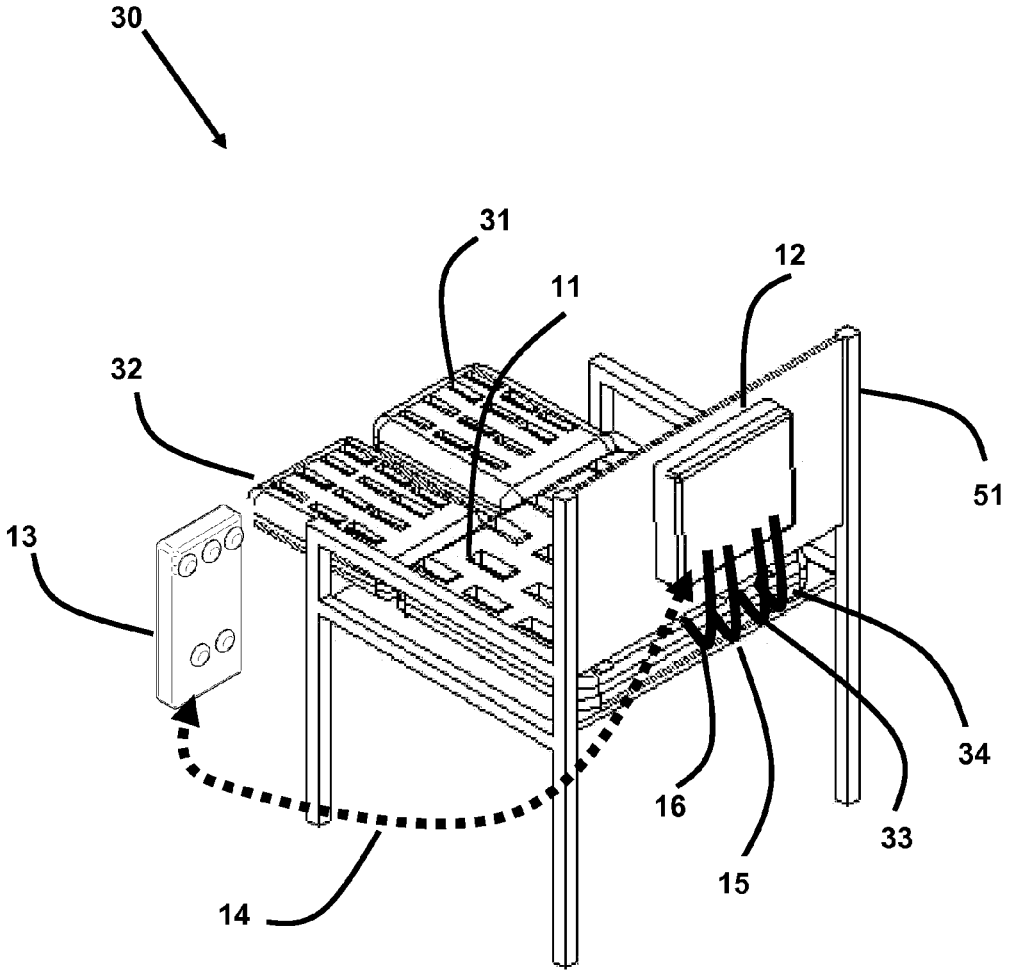
FIG. 7 is a rear perspective view of a plurality of portable pneumatic pad platform seating devices of the present invention used on a common chair.
Figure 8:
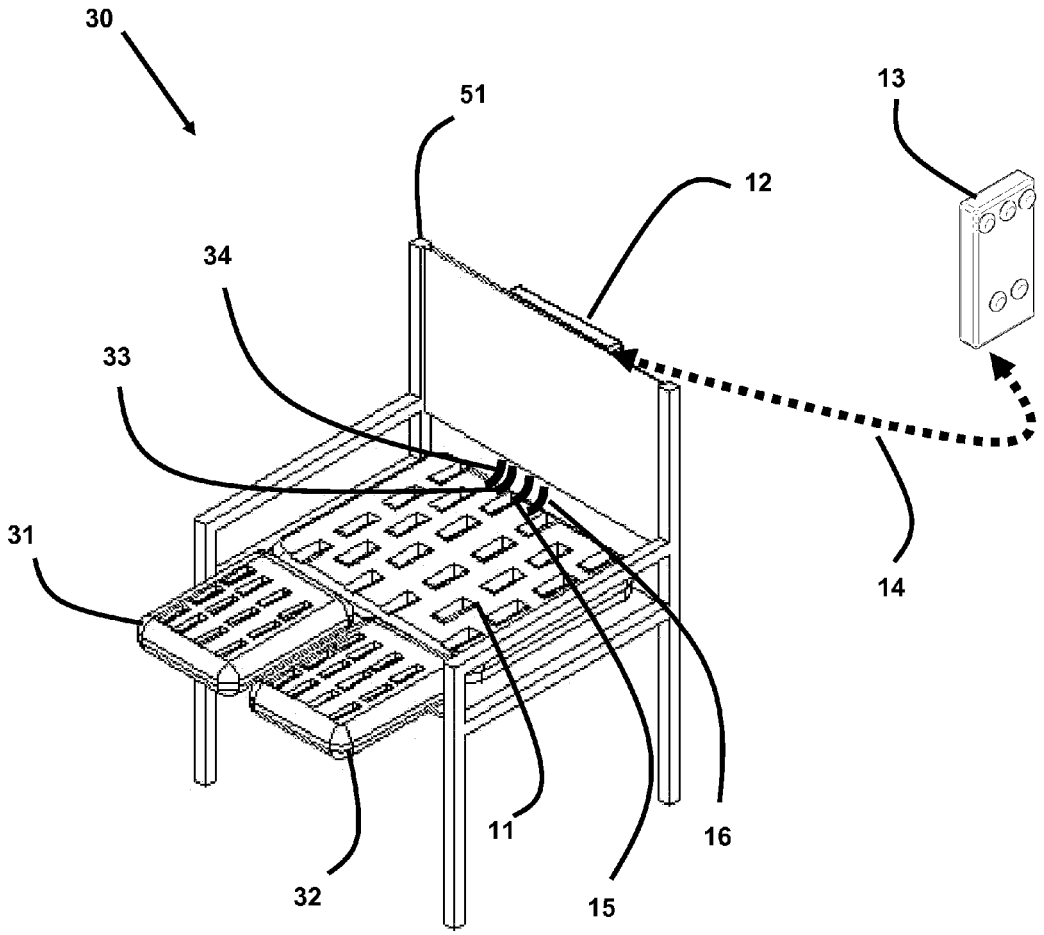
FIG. 8 is a front perspective view of a plurality of portable pneumatic pad platform seating device of the present invention used on a common chair.

FIGS. 5 and 6 show a rear view and front view of a portable pneumatic seating device 10 positioned in a substantially horizontal position supported by a common chair 51, controlled by remote control module 13, controller module 12, pneumatic tubes 15 and 16, pneumatic pad module 11, and communication process 14. The portable pneumatic seating device 10 communicates functional operational commands to controller module 12 via remote control module 13 through communication process 14, and controller module 12 supplies or removes pneumatic pressure to pneumatic pad module 11 via pneumatic tubes 15 and 16. The portable pneumatic seating device may be affixed or attached to the supporting chair 51 using common adhesive products such as tape, rope, double sided hook and pile fasteners, snaps and the like. The pneumatic pad is positioned substantially horizontal in the chair 51 and secured as to minimize relative vertical or horizontal movement, and pneumatic tubes are secured to the inflatable cushion prevent pneumatic pressure leakage during operation FIGS. 7 and 8 show a rear view and front view there is show a portable pneumatic seating device 30 positioned in a substantially horizontal position to a common chair 51 controlled by remote control module 13, controller module 12, pneumatic tubes 15, 16, 33, 34, pneumatic pad module 11, pneumatic pad modules 31 and 32 and communication process 14. The portable pneumatic seating device 30 communicates functional operational commands to controller module 12 via remote control module 13 through the communication process 14, and controller module 12 supplies or removes pneumatic pressure to pneumatic pad module 11, pneumatic modules 31 and 32 via pneumatic tubes 15, 16, 33, 34.

Figure 9:
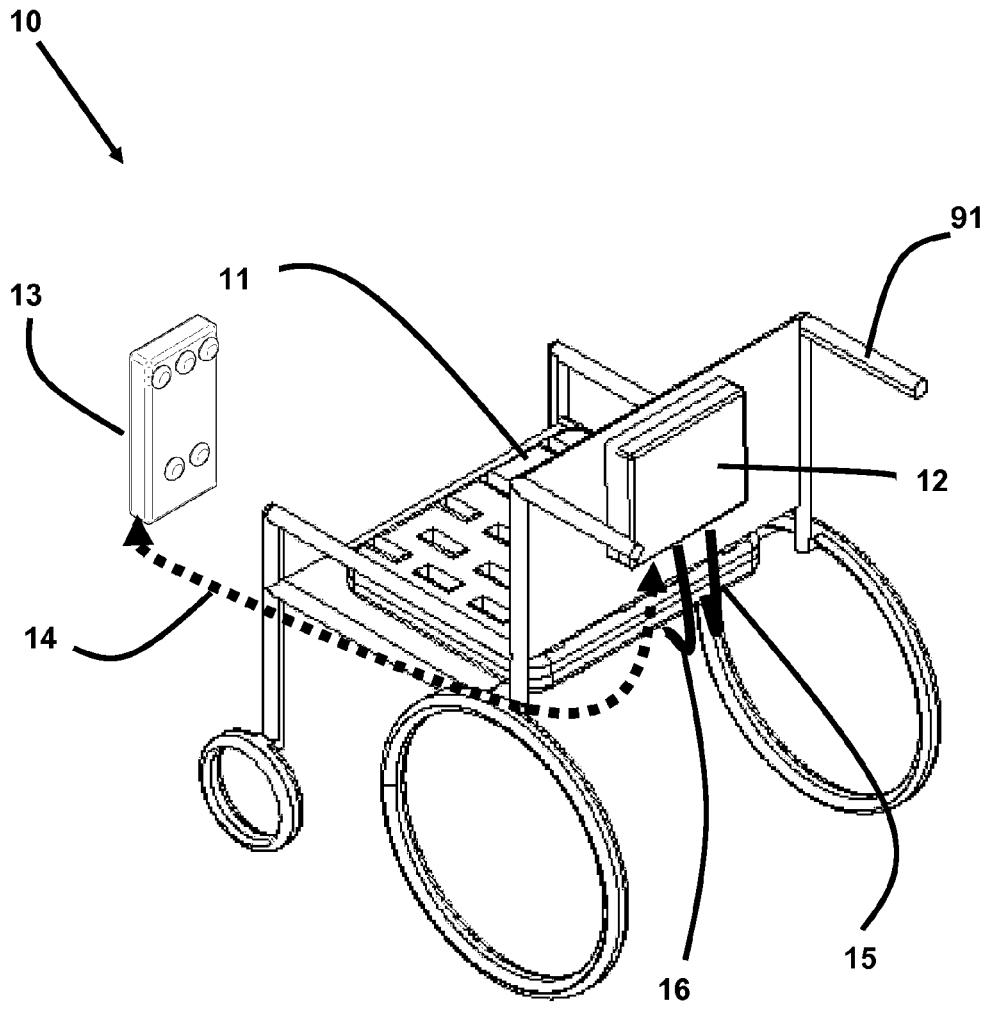
FIG. 9 is a rear perspective view of a single portable pneumatic pad platform seating device of the present invention used on a common wheelchair.
Figure 10:
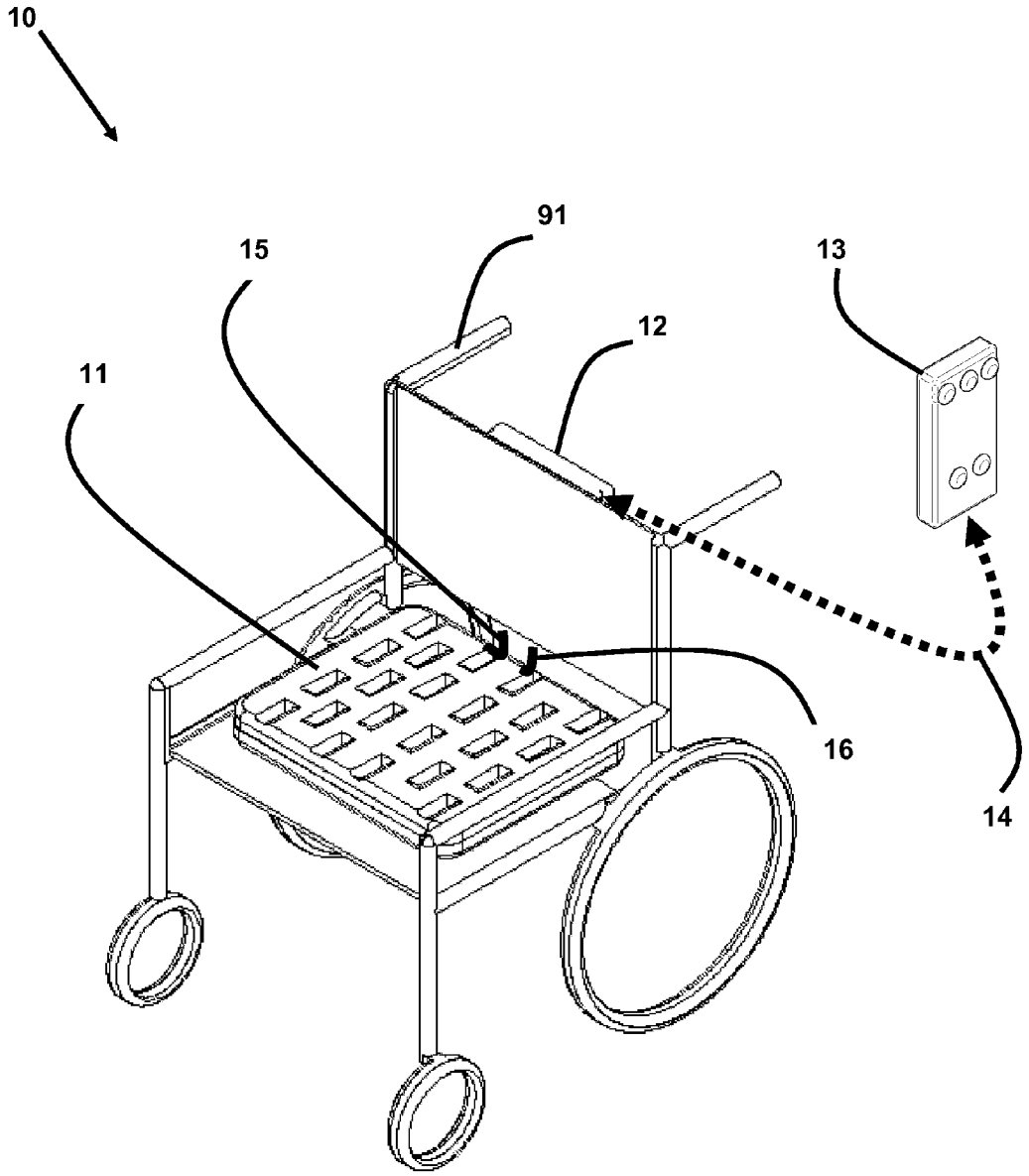
FIG. 10 is a front perspective view of a single portable pneumatic pad platform seating device of the present invention used on a common wheelchair.

FIGS. 9 and 10 show a rear view and front view of a portable pneumatic seating device 10 positioned in a substantially horizontal position to a common wheelchair 91, controlled by remote control module 13, controller module 12, pneumatic tubes 15 and 16, pneumatic pad module 11, and communication process 14. The portable pneumatic seating device 10 communicates functional operational commands to controller module 12 via remote control module 13 through the communication process 14, and controller module 12 supplies or removes pneumatic pressure to pneumatic pad module 11 via pneumatic tubes 15 and 16.

Figure 11:
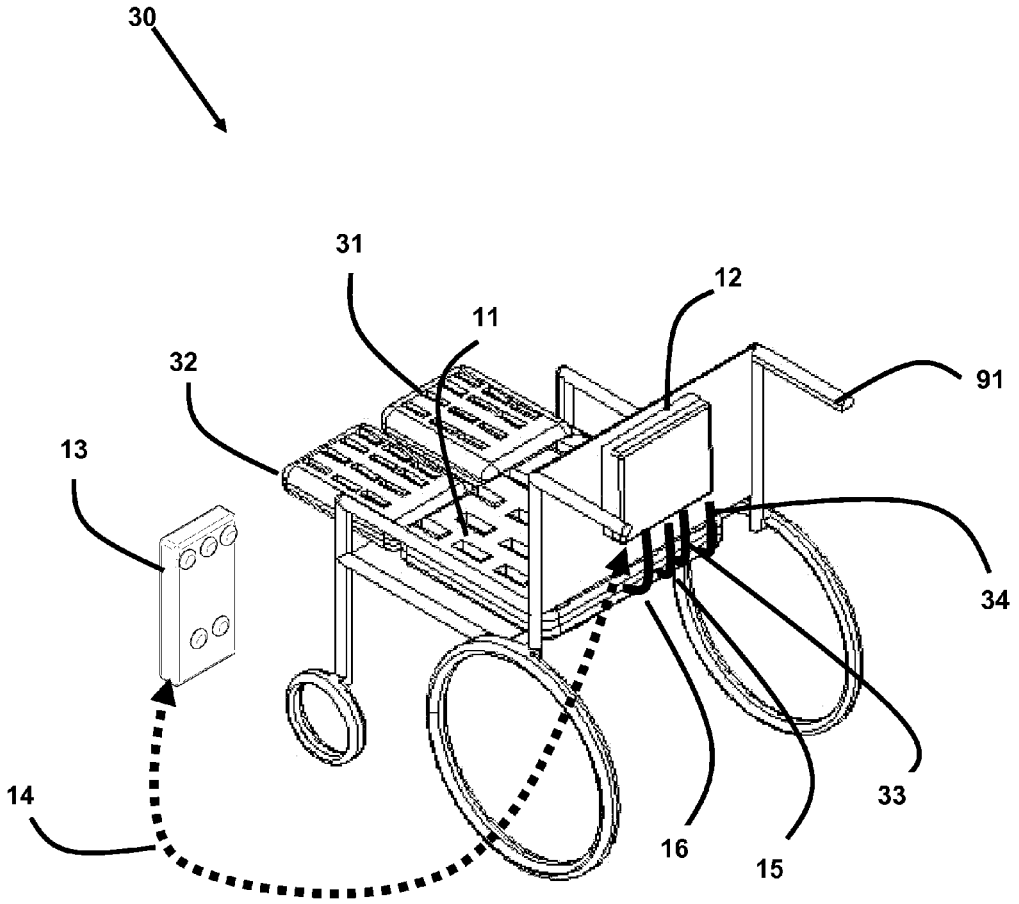
FIG. 11 is a rear view of a plurality of portable pneumatic pad platform seating devices of the present invention used on a common wheelchair.
Figure 12:
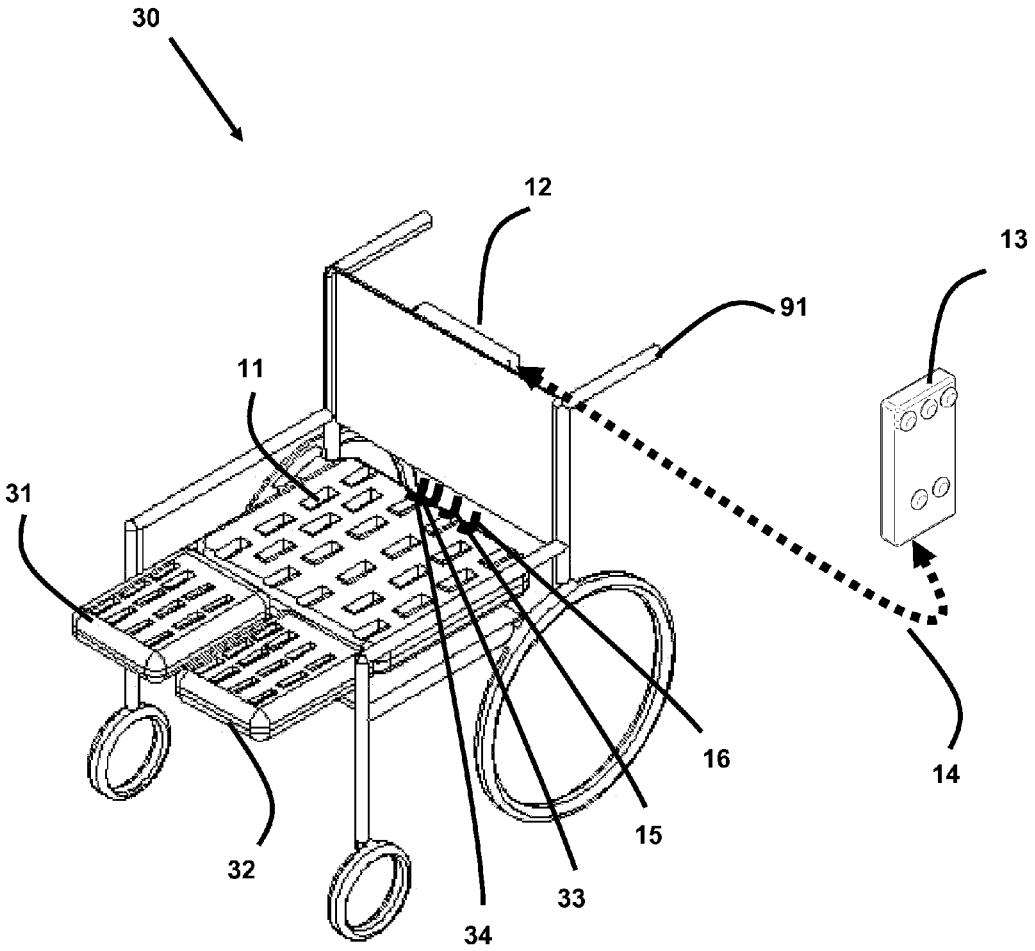
FIG. 12, is a front view of a plurality of portable pneumatic pad platform seating devices of the present invention used on a common wheelchair.
Figure 13:
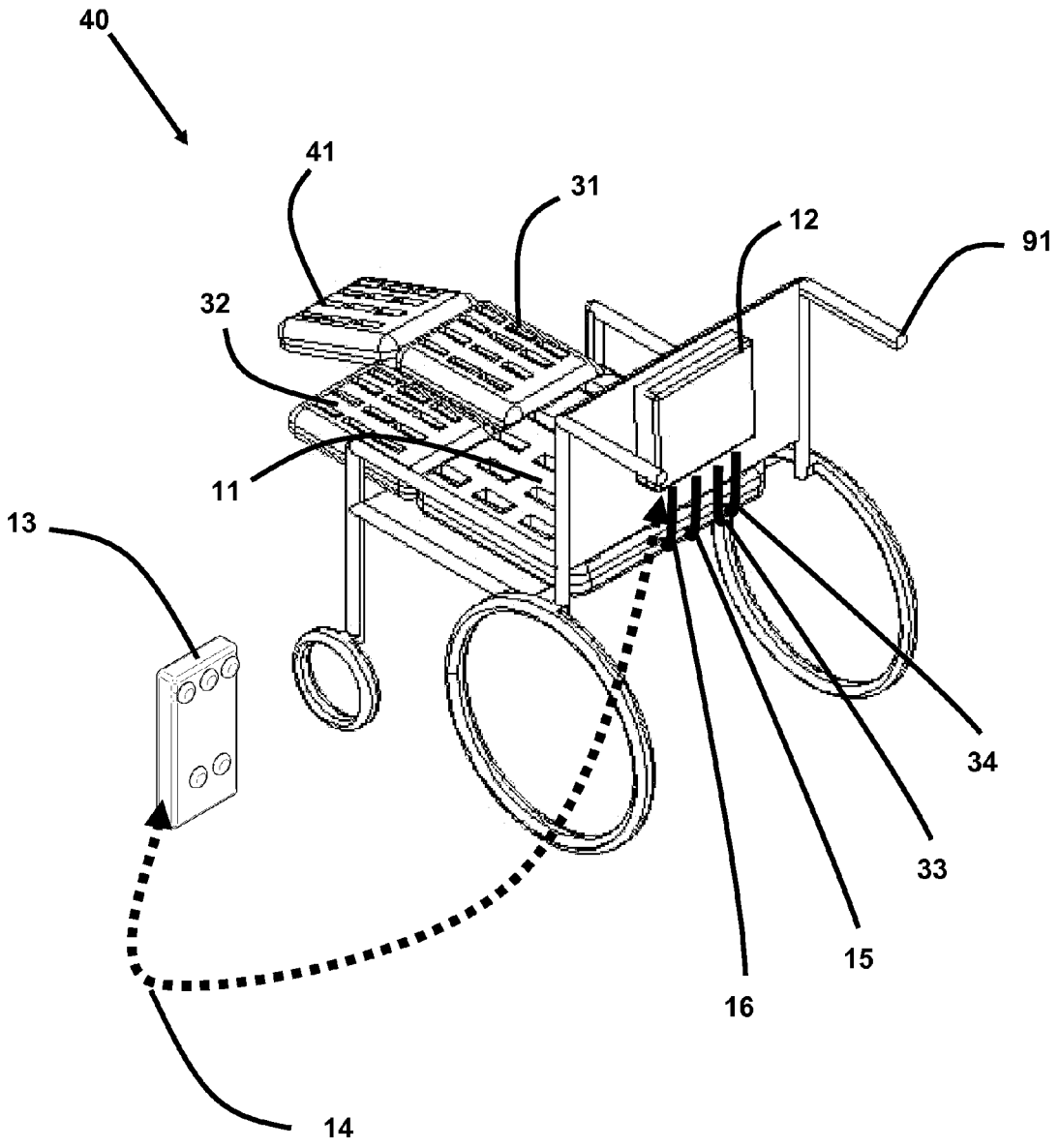
FIG. 13 is a front view of staggered plurality of portable pneumatic pad platform seating devices of the present invention used on a common wheelchair.

FIGS. 11 and 12 show a rear view and front view of a portable pneumatic seating device 30 positioned in a substantially horizontal position to a common wheelchair 91 controlled by remote control module 13, controller module 12, pneumatic tubes 15, 16, 33, 34, pneumatic pad module 11, pneumatic pad modules 31 and 32, and communication process 14. The portable pneumatic seating device 30 communicates functional operational commands to controller module 12 via remote control module 13 through the communication process 14, and controller module 12 supplies or removes pneumatic pressure to pneumatic pad module 11, and pneumatic pad modules 31 and 32 via pneumatic tubes 15, 16, 33, 34.

FIGS. 13, 14A, 14B, 14C and 14D show a rear view and front view of a portable pneumatic seating device 40 positioned in a substantially horizontal position on a common wheelchair 91 controlled by remote control module 13, controller module 12, pneumatic tubes 15, 16, 33, 34, 35, 56 (FIG. 14C), 57 and 58 (FIG. 14D), pneumatic pad module 11, pneumatic pads 31, 32, 41, and 42, and communication process 14. FIGS. 14A, 14B, 14C, and 14D additionally show pneumatic pad 42, which is connected to the controller module through pneumatic tube 35. FIGS. 14B and 14C additionally show a leg lifting mechanism comprising a bellows (FIG. 14B), a piston (FIG. 14C), or a tube (FIG. 14D). The portable pneumatic seating device 40 communicates functional operational commands to controller module 12 via remote control module 13 through communication process 14, and controller module 12 supplies or removes pneumatic pressure to pneumatic pad module 11, pneumatic modules 32, 32, 41, 42 via pneumatic tubes 15, 16, 33, 34, 35.

Pneumatic pad 41 can be pressurized or depressurized by incorporating pneumatic tubes between 31 or 32 and 41, or by incorporating a pneumatic passageway between 31 or 32 and 41 so as to allow the passage or removal of pneumatic pressure, while ensuring pressure retention during operation.

Figure 15:
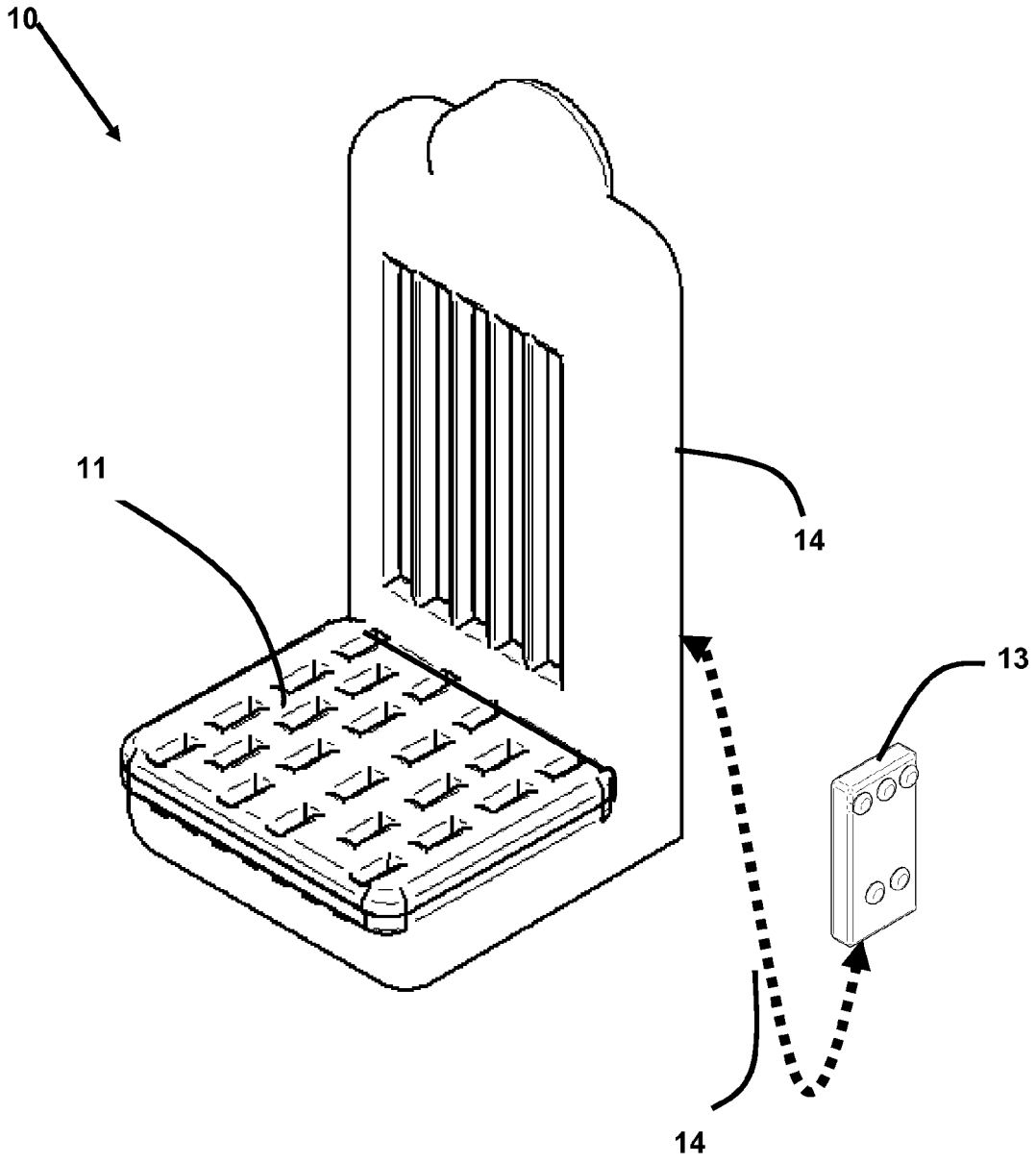
FIG. 15 is a front view of a single portable pneumatic pad platform seating device of the present invention used on a common vehicle seat.
Figure 16:
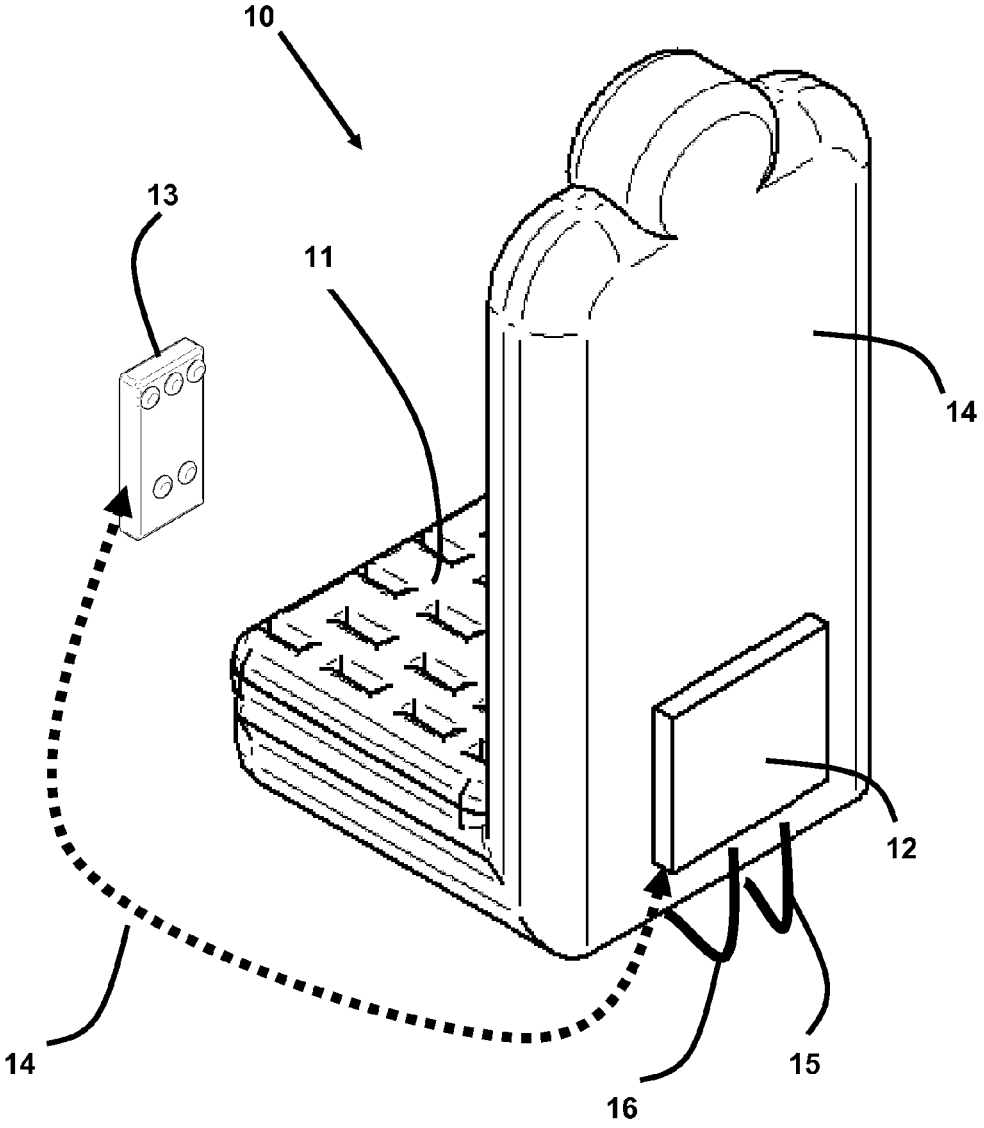
FIG. 16 is a rear view of a single portable pneumatic pad platform seating device of the present invention used on a common vehicle seat.

FIGS. 15 and 16 show a rear view and front view of a portable pneumatic seating device 10 positioned in a substantially horizontal position on a common vehicle seat 151 controlled by remote control module 13, controller module 12, pneumatic tubes 15, 16, pneumatic pad module 11, and communication process 14. The portable pneumatic seating device 10 communicates functional operational commands to controller module 12 via remote control module 13 through the communication process 14, and controller module 12 supplies or removes pneumatic pressure to pneumatic pad module 11, via pneumatic tubes 15, 16.

Figure 17:
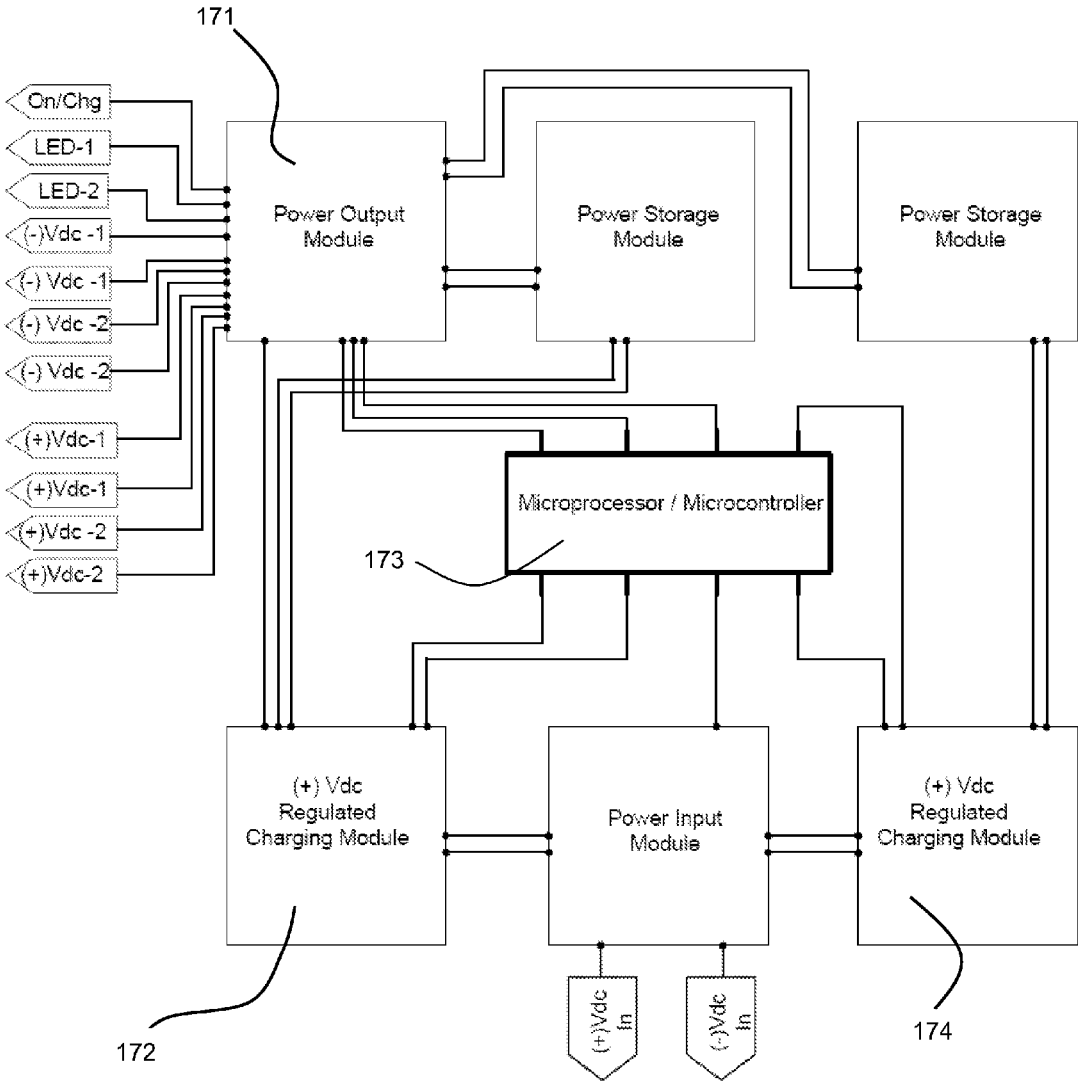
FIG. 17 is a schematic drawing of a power management circuit of the present invention.

FIG. 17 shows a schematic diagram of the power management module 24, which provides two power recharge voltage segments 172 and 174, controlled by microprocessor and ancillary discrete components 173, to recharge power modules 23 (rechargeable batteries) and by a distribution voltage and current network 171. The various circuit boards use standard engineering practice for printed circuit board material, normally laminate fiberglass single sided copper using either through hole or SMD components, and submodules can be affixed or attached to the respective components using any type of rapid disconnect devices (e.g., modular connectors). The power recharge voltage segments 172 and 174 are controlled by microprocessor 173 and allow for a power shutdown of the charging process if the power modules are fully charged or if a designated time period has been reached.

Figure 18:
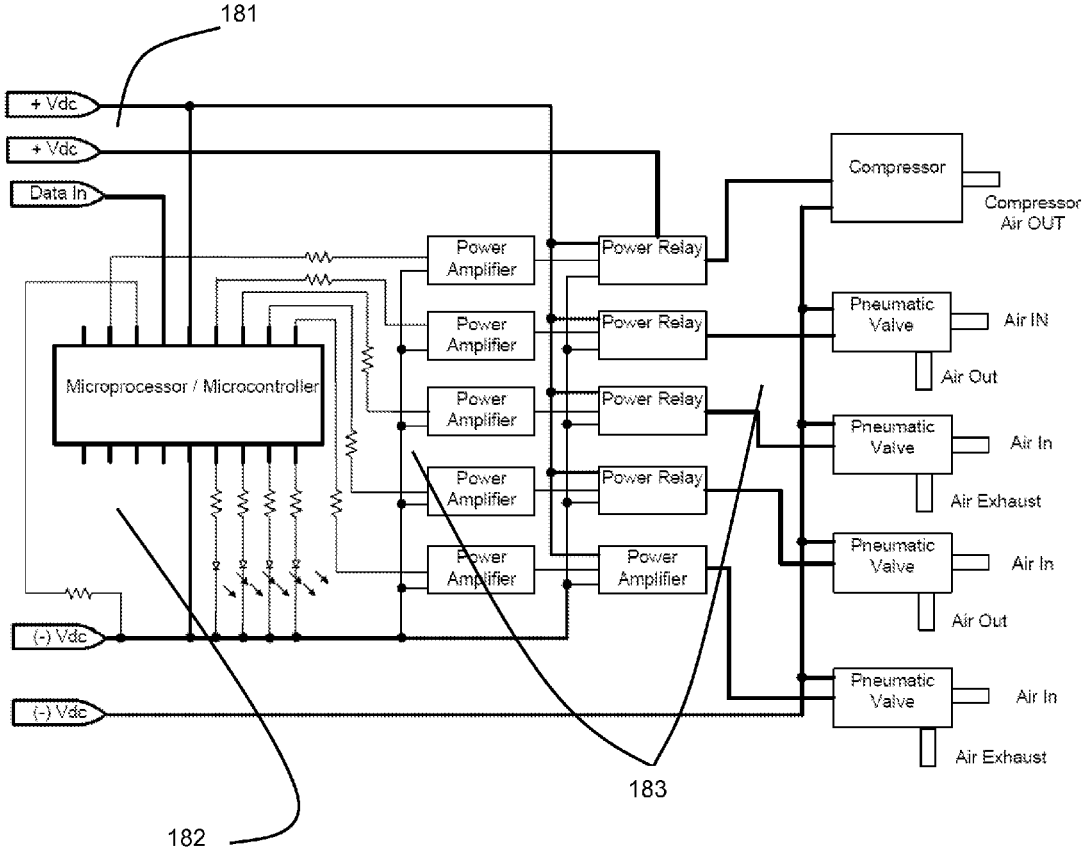
FIG. 18 is a schematic drawing of a receiving and digital processor circuit of the present invention.

FIG. 18 shows a schematic diagram of the receiver and digital process module 26, which provide received data 181 from remote control module 13, microprocessor and ancillary discrete components for controlling and processing digital signals 182, output distribution network for controlling compressor 21 and valve module 25. The receiver and digital process module 26 receives digital signals supplied by the remote control module 13 and respectively controls power delivery to the compressor module 21 and valve module 25. The receiver and digital process module 26 incorporates such safety features as removing pressure from pneumatic pad modules 11, 31, 32, 41 if either portable pneumatic seating devices 10, 30, 40 are disabled, reset, or being charged.

Figure 19:
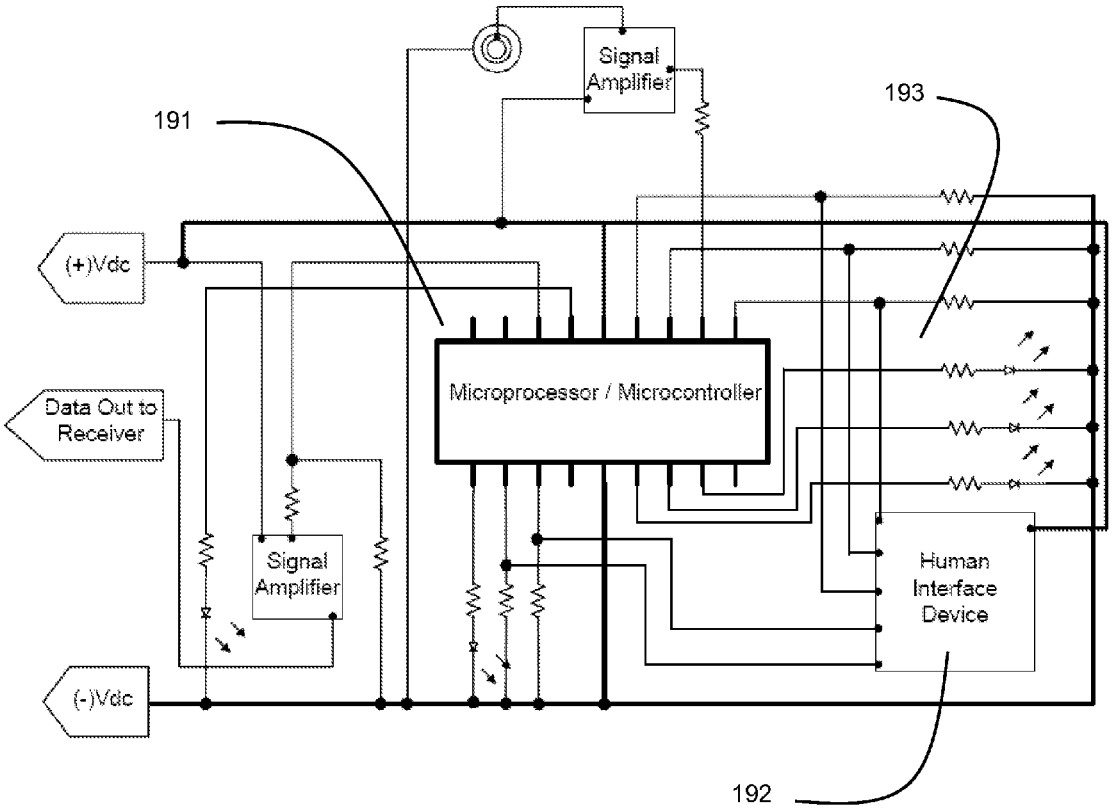
FIG. 19 is a schematic drawing of a remote control circuit of the present invention.

FIG. 19 shows a schematic diagram of the remote control module 13, which includes microprocessor 191, function input matrix 192, and notification indicators 193. The remote control module 13 transmits command and control signals through the communication process 14.

The functions being sent using remote control module 13 can be user defined or preset. The power needed for the operation of the remote control module 13 can be supplied using power management module 24 or by power stored within remote control module 13.

Figure 20:
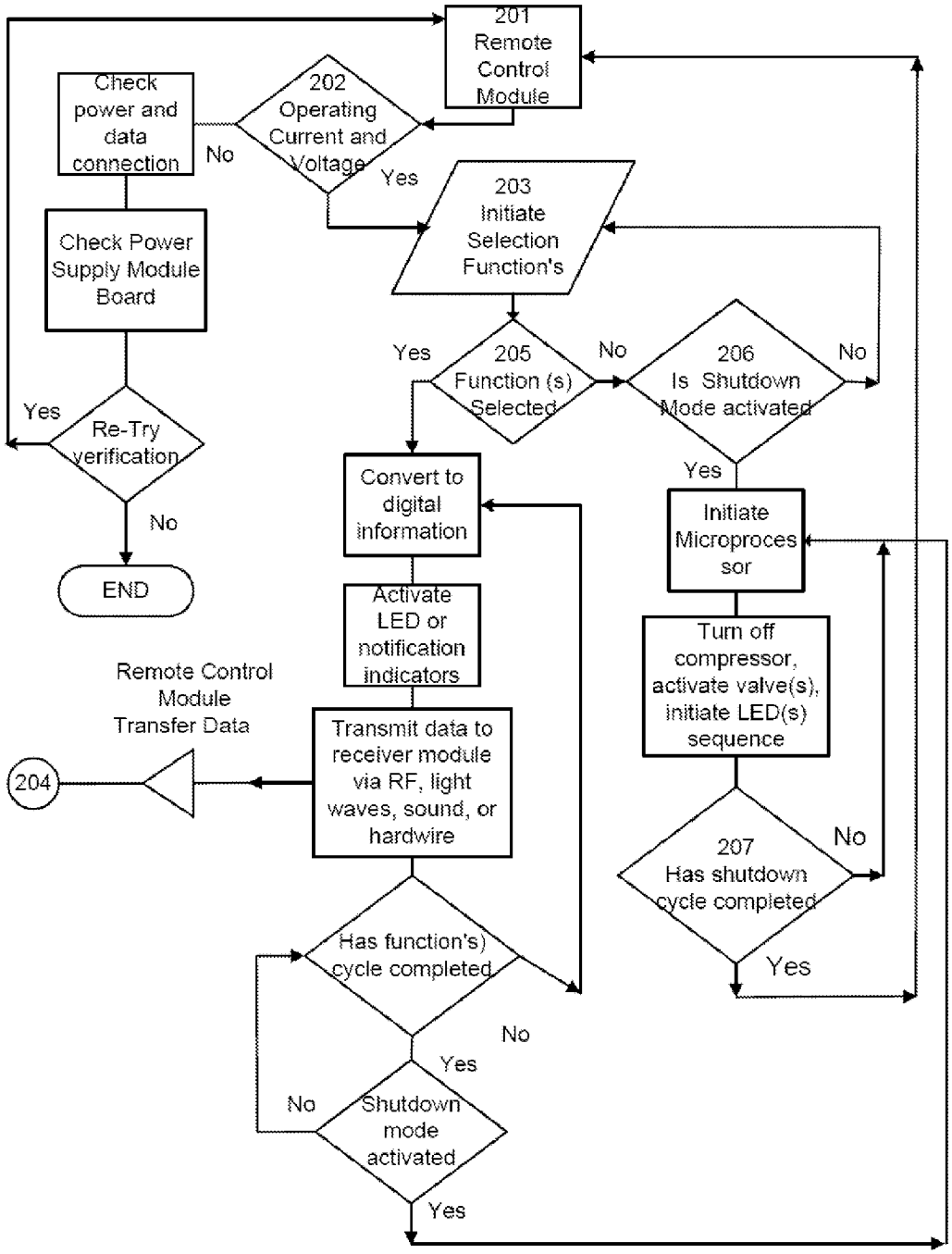
FIG. 20 is a flow chart diagram of the remote control function of the present invention.

FIG. 20 shows a sample flow chart diagram of the remote control module 13. The flow chart diagram outlines a typical flow process for power supply checking, 201, 202, function commands transmitted out 203, 205, 204, system ON and system shutdown mode 206, 207.

FIG. 20 illustrates a straight forward approach of process calls that enable ease of firmware code generation, however, alternate approaches may be employed.

Figure 21:
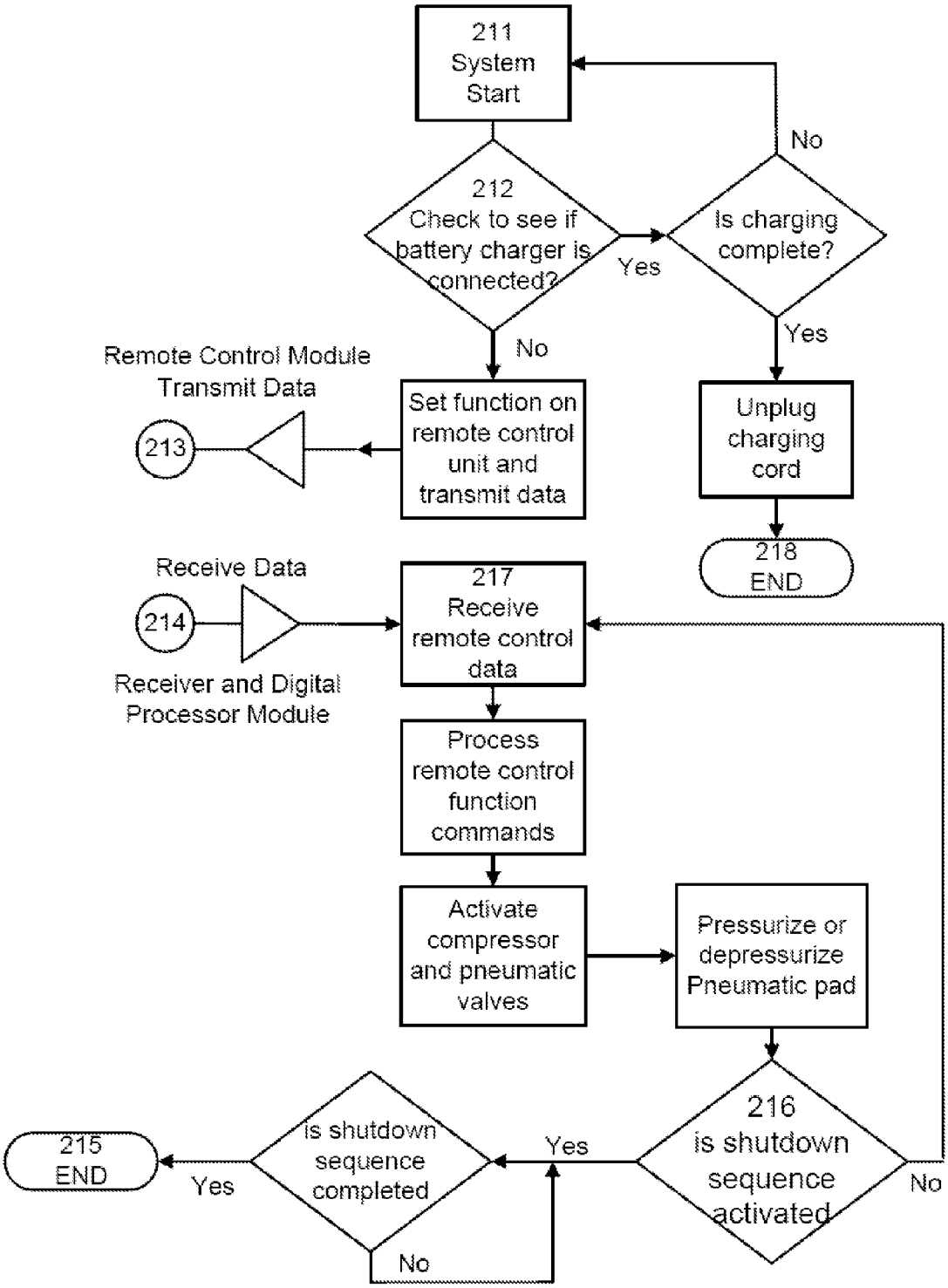
FIG. 21 is a flow chart diagram of the operational process of the present invention.

FIG. 21, shows a flow chart of the present invention wherein on system start 211, the process checks to see if the power modules are in charging mode 212, and if they are, then return to 211, and if not the desired function is set and the data transmitted out 213, the data is received 214, through the receiver and digital process module 26. Once the commands are decoded 217, through microprocessor 181, the timing functions are established for that particular function and executed through 183, and step 216 checks to see if shutdown mode has been initiated, and if not then repeat the current function until a new function is selected or the system is set to shutdown mode 216, and if in shutdown mode, check to see if shutdown mode has been completed, and if not wait until shutdown mode has completed, and if completed turn off the system and end 215.

The advantages of the present invention include, without limitation, that it is portable and exceedingly easy to transport. It is easy to move these devices into a house, hospital, healthcare facility, office or be used in a vehicle because they are relatively small and lightweight. Moving such devices typically requires a single person. Further, the devices generally will pass through most doorways without any widening. Further, the devices can easily be moved from spot to spot wither inside a room or in open area outside, In broad embodiment, the present invention is a seat that is pressurized or depressurized causing the present invention to expand vertically and horizontally or elevated above the base of a surface by using at least one pneumatic pad module.

The above description discusses various features, options and prior known embodiments which are incorporated by reference. This disclosure is intended to encompass all feasible combinations, subcombinations, permutations and alternate implementations within the scope of the various disclosure, even if not described as a single example herein. Further, each respective feature, option and embodiment is not required to be combined with any other feature.

While the foregoing written description of the invention enables one of technical skill to make and use what is considered presently to be the best mode thereof, those of technical skill will understand and appreciate the existence of variations, combinations, and equivalents of the specific embodiment, method, and examples herein.

The invention should therefore not be limited by the above described embodiment, method, and examples, but by all embodiments and methods within the scope and spirit of the invention as claimed.

What is claimed is:

1. An inflatable seat cushion device for supporting an occupant above a horizontally disposed support surface, comprising:

a power source;

at least one air compressor;

a distribution manifold configured to receive compressed air from the at least one air compressor, and to selectively distribute the compressed air to a plurality of ports;

a mechanism to selectively relieve a pressure at the plurality of ports;

a plurality of inflatable chambers, each having a flexible wall, a conduit communicating air with a respective port, each inflatable chamber having a pressure responsive to an amount of air within the respective inflatable chamber, the plurality of inflatable chambers comprising at least a pair of thigh support chambers, and at least one buttocks support chamber;

at least one auxiliary chamber having a flexible wall, configured, when inflated through the distribution manifold, to tension the flexible wall to cause at least one portion of the flexible wall to move upward to assume a position generally parallel to the horizontally disposed support surface, and generate a force sufficient to extend a knee of the occupant of the inflatable seat cushion device supported by the horizontally disposed support surface, and when deflated through the mechanism, to assume a position generally perpendicular to the horizontally disposed support surface and permit flexion of the knee of the occupant of the inflatable seat cushion device; and a control device, configured to control at least the distribution manifold and the at least one air compressor, having a communication interface configured to receive control information for controlling an operation of at least the air compressor and distribution manifold over time and a memory configured to store at least the received control information.

2. The inflatable seat cushion device according to claim 1, wherein the power source comprises a solar panel.

3. The inflatable seat cushion device according to claim 1, wherein the power source comprises an electric wheelchair battery.

4. The inflatable seat cushion device according to claim 1, wherein the at least one air compressor comprises a plurality of air compressors, and the right and left knees of the occupant are independently extended.

5. The inflatable seat cushion device according to claim 1, further comprising a pressurized air accumulator, configured to receive compressed air from a respective air compressor and to supply compressed air to the distribution manifold when the respective air compressor is inactive.

6. The inflatable seat cushion device according to claim 1, wherein the distribution manifold comprises a plurality of electrically operated valves, and the right and left knees of the occupant are independently extended.

7. The inflatable seat cushion device according to claim 1, wherein the mechanism comprises a plurality of electrically operated relief valves, and the right and left knees of the occupant are independently flexed.

8. The inflatable seat cushion device according to claim 1, further comprising an electrically operated valve which selectively communicates between two inflatable chambers.

9. The inflatable seat cushion device according to claim 1, further comprising an electrically operated air pump configured to selectively transfer air between two inflatable chambers, and the right and left knees of the occupant are separately extended and flexed.

10. The inflatable seat cushion device according to claim 1, wherein the at least one auxiliary chamber comprises a first portion having a maximum operating pressure of 3 psi configured to provide cushioning support of a lower extremity of the occupant, and tubular inflatable structure configured to have an operating pressure exceeding 3 psi, and in response to the operating pressure exceeding 3 psi, extend horizontally from a seating surface when inflated to lift the first portion.

11. The inflatable seat cushion device according to claim 1, wherein the communication interface comprises at least one IEEE-802 series standard protocol.

12. A method of operating an inflatable seat cushion device supporting an occupant above a horizontally disposed support surface, comprising:

providing a plurality of inflatable chambers, each having a flexible wall, a conduit communicating air with a respective port, each inflatable chamber having a pressure responsive to an amount of air within the respective inflatable chamber, the plurality of inflatable chambers comprising at least a pair of thigh support chambers, and at least one buttocks support chamber;

providing at least one auxiliary pneumatic device having a flexible wall, configured, when inflated, to tension the flexible wall to cause at least one portion of the flexible wall to move upward to assume a position generally parallel to the horizontally disposed support surface, and generate a force sufficient to extend a knee of the occupant of the inflatable seat cushion device supported by the horizontally disposed support surface, and when deflated, to assume a position generally perpendicular to the horizontally disposed support surface and permit flexion of the knee of the occupant of the inflatable seat cushion device;

receiving compressed air from at least one air compressor, selectively distributing the compressed air to a plurality of respective ports, and relieving a pressure at a selected one of the plurality of ports, to thereby inflate and deflate the plurality of chambers and the at least one auxiliary pneumatic device;

storing received control information in a memory; and controlling at least the at least one air compressor and at least one relief device over time with a control device to inflate and deflate the plurality of inflatable chambers and the at least one auxiliary pneumatic device.

13. The method according to claim 12, further comprising supplying compressed air to a pneumatic actuator at a pressure of at least 3 psi to operate the at least one auxiliary chamber, and supplying compressed air to the plurality of inflatable chambers at a pressure of at most 3 psi.

14. The method according to claim 12, wherein the control information is received through a communication interface according to at least one IEEE-802 series standard protocol.

15. The method according to claim 12, wherein the at least one air compressor comprises a plurality of air compressors, further comprising operating at least two air compressors concurrently, and the right and left knees of the occupant are independently extended.

16. The method according to claim 12, further comprising receiving compressed air from a respective air compressor into an air accumulator and supplying the compressed air from the accumulator to the distribution manifold when the respective air compressor is inactive.

17. The method according to claim 12, further comprising controlling a flow of air by the control device with a plurality of electrically operated valves, and the right and left knees of the occupant are independently flexed.

18. The method according to claim 12, further comprising balancing a pressure between two inflatable chambers based on an electrical signal.

19. A pneumatic lower extremity exercise device for a subject supported above a horizontally disposed support surface, comprising:

a power source;

at least one air compressor;

a pressure relief mechanism;

at least one pneumatic support cushion having a flexible wall, configured to rest on the horizontally disposed support surface and to be inflated to support the subject above the horizontally disposed support surface;

at least one pneumatic device having a flexible wall, configured, when subject to air pressure from the at least one air compressor, to tension the flexible wall to cause at least one portion of the flexible wall to move upward to assume a position generally parallel to the horizontally disposed support surface, and generate a force sufficient to extend the knee of the subject, and when deflated, to assume a position generally perpendicular to the horizontally disposed support surface and permit flexion the knee of the subject; and a control device, configured to control at least the at least one air compressor and the relief mechanism, having a communication interface configured to receive and store control information for controlling at least an operation of the air compressor and the pressure relief mechanism over time and to separately control a pressure in the at least one pneumatic support cushion and the at least one pneumatic device.

20. The device according to claim 19, wherein a pressure of the at least one pneumatic support cushion is controlled not to exceed 3 psi and a pressure of the at least one pneumatic device is controlled to have a pressure exceeding 3 psi when the flexible wall is tensioned to cause the at least one portion of the flexible wall to move upward to assume a position generally parallel to the horizontally disposed support surface.

* * * * *